US012053690B2

(12) United States Patent
Kermani et al.

(10) Patent No.: US 12,053,690 B2
(45) Date of Patent: Aug. 6, 2024

(54) PERSONAL MOBILITY VEHICLES WITH ADJUSTABLE WHEEL POSITIONS

(71) Applicant: Razor USA LLC, Cerritos, CA (US)

(72) Inventors: Ali Kermani, Cerritos, CA (US); Kyle McDonald, Cerritos, CA (US)

(73) Assignee: Razor USA LLC, Cerritos, CA (US)

( * ) Notice: Subject to any disclaimer, the term of this patent is extended or adjusted under 35 U.S.C. 154(b) by 0 days.

(21) Appl. No.: 17/936,807

(22) Filed: Sep. 29, 2022

(65) Prior Publication Data

US 2023/0102779 A1 Mar. 30, 2023

Related U.S. Application Data

(60) Provisional application No. 63/263,438, filed on Nov. 2, 2021, provisional application No. 63/261,935, filed on Sep. 30, 2021.

(51) Int. Cl.
*A63C 17/01* (2006.01)
*A63C 17/00* (2006.01)

(52) U.S. Cl.
CPC ..... *A63C 17/016* (2013.01); *A63C 17/0033* (2013.01); *A63C 2203/42* (2013.01)

(58) Field of Classification Search
CPC ..... A63C 17/016; A63C 17/0033; A63C 2203/42
See application file for complete search history.

(56) References Cited

U.S. PATENT DOCUMENTS 2,051,762 A 8/1936 Vincent
3,288,251 A 11/1966 Paul
(Continued)

FOREIGN PATENT DOCUMENTS

AU 2007214338 3/2007
CA 2596570 10/2007
(Continued)

OTHER PUBLICATIONS

"About: Skateboarding; Other Boardsports", http://skateboard.about.com/cs/fringeboarding/gr/?once-true&; Mar. 2007, in 2 pages.
(Continued)

*Primary Examiner* — Brian L Swenson
(74) *Attorney, Agent, or Firm* — Knobbe, Martens, Olson & Bear, LLP

(57) ABSTRACT

An adjustable wheel mobility vehicle can have a support structure for supporting a rider, a modular conveying feature with a wheel, and an attachment that physically and tightly secures the modular conveying feature to the support structure in at least two different positions. A tool-free mechanism can allow a user to free the modular conveying feature from the support structure for movement to another position. A system for adjusting a skateboard wheel position can include a wheel support structure having multiple wheel attachment positions, and a wheel assembly comprising a skateboard wheel and a base. The wheel can swivel with respect to the base and the base can join to the wheel support structure. The base and wheel support structure can tightly join to prevent rotation of the base with respect to the wheel support structure and that tightly retain the base in a first attachment position. A release feature can allow a user to easily loosen the base and reposition it in a second attachment position.

32 Claims, 16 Drawing Sheets

(56) References Cited

U.S. PATENT DOCUMENTS 3,399,904 A 9/1968 Schinke
3,399,906 A 9/1968 Portnoff
3,771,811 A 11/1973 Bueno
3,982,766 A 9/1976 Budge
D243,206 S 1/1977 Sherwood
4,037,852 A 7/1977 Bayer et al.
D246,065 S 10/1977 Saul
4,060,253 A 11/1977 Oldendorf
4,076,265 A * 2/1978 Eash ..... A63C 17/0086 280/11.27
4,076,267 A 2/1978 Lipscomb
4,082,306 A 4/1978 Sheldon
4,092,033 A 5/1978 Swain
4,093,252 A 6/1978 Rue
D250,492 S 12/1978 Kish
4,140,326 A 2/1979 Huber
4,245,848 A 1/1981 Dudouyt
4,295,656 A 10/1981 Moore
4,359,231 A 11/1982 Mulcahy
4,411,442 A 10/1983 Rills
4,451,055 A 5/1984 Lee
4,902,256 A 2/1990 Berglund
4,915,403 A 4/1990 Wild
4,921,513 A 5/1990 Parten
4,930,794 A 6/1990 Chan
4,930,924 A 6/1990 Hunt
4,955,626 A 9/1990 Smith
5,029,702 A * 7/1991 Tong ..... B65D 73/00 206/775
5,067,058 A 11/1991 Standley
5,098,087 A 3/1992 Matile
5,160,155 A 11/1992 Barachet
5,221,111 A 6/1993 Younger
5,267,743 A 12/1993 Smisek
D345,406 S 3/1994 Shankland
D346,418 S 4/1994 Fischbach
5,330,026 A 7/1994 Hsu et al.
5,347,681 A 9/1994 Wattron et al.
5,419,570 A 5/1995 Bollotte
5,458,351 A 10/1995 Yu
5,460,558 A 10/1995 Woodstock
5,492,345 A 2/1996 Kruczek
5,505,474 A 4/1996 Yeh
5,529,523 A 6/1996 Wilhelmi
5,540,455 A 7/1996 Chambers
5,549,331 A 8/1996 Yun
5,566,956 A 10/1996 Wang
5,601,299 A 2/1997 Yun
5,622,759 A 4/1997 Fuster
5,707,068 A 1/1998 Bradfield
5,766,051 A 6/1998 Messer
5,826,895 A 10/1998 Bradfield
5,853,182 A 12/1998 Finkle
5,855,385 A 1/1999 Hambsch
5,884,983 A 3/1999 Wu
5,893,425 A 4/1999 Finkle
D410,515 S 6/1999 Alexander
5,910,035 A 6/1999 Rebotier et al.
D413,954 S 9/1999 Gerlach
5,947,495 A 9/1999 Null et al.
5,984,328 A 11/1999 Tipton
D422,661 S 4/2000 Edwards et al.
D422,662 S 4/2000 Edwards et al.
6,050,357 A 4/2000 Staelin
6,056,302 A 5/2000 Smith
6,059,303 A 5/2000 Bradfield
6,102,415 A 8/2000 Stewardson
6,106,347 A 8/2000 Harness
6,193,249 B1 2/2001 Buscaglia
6,206,389 B1 3/2001 Yagi
6,254,113 B1 7/2001 Dornan
6,293,565 B1 9/2001 Bouchard et al.
6,315,304 B1 11/2001 Kirkland et al.
6,328,328 B1 12/2001 Finiel
6,338,494 B1 1/2002 Killian
D455,186 S 4/2002 Koester
D456,047 S 4/2002 Mandic
6,398,237 B1 6/2002 Attey
6,419,248 B1 7/2002 Kay
6,419,249 B1 7/2002 Chen
6,428,022 B1 8/2002 Namiki
6,440,526 B1 8/2002 Gamble et al.
6,481,724 B1 11/2002 Whipp
6,485,044 B1 11/2002 Blake
6,494,467 B1 12/2002 Menges
6,502,850 B1 1/2003 Schaller et al.
6,572,130 B2 6/2003 Greene et al.
6,669,215 B2 12/2003 Laporte
6,698,776 B2 3/2004 Todd
6,808,196 B2 10/2004 Des Ouches
6,863,292 B1 3/2005 Paasch et al.
D503,763 S 4/2005 Morgan
D506,427 S 6/2005 Weber
6,910,698 B2 6/2005 Turner et al.
D510,046 S 9/2005 Li
6,976,687 B2 12/2005 Beleki, Jr.
6,979,006 B2 12/2005 Pierron
7,044,486 B2 5/2006 Wright
7,053,289 B2 5/2006 Iwai et al.
7,070,193 B2 * 7/2006 Yamaguchi ..... A63C 17/0086 280/11.26
7,083,178 B2 8/2006 Potter
7,093,842 B2 8/2006 Potter
7,182,360 B2 2/2007 Paasch et al.
7,195,259 B2 3/2007 Gang
7,198,280 B2 4/2007 Hara
7,213,823 B1 5/2007 Vujtech
7,252,625 B1 8/2007 Perka
D552,201 S 10/2007 Kwak
D556,283 S 11/2007 Hamborg et al.
7,316,597 B2 1/2008 Skedeleski
D561,289 S 2/2008 Stanisewski
7,325,819 B2 2/2008 Kwak
D564,613 S 3/2008 Hamborg
7,338,056 B2 3/2008 Chen et al.
7,367,572 B2 5/2008 Jiang
D572,332 S 7/2008 Sramek et al.
D577,789 S 9/2008 Mazur
7,441,787 B1 * 10/2008 Jordan ..... A63C 17/006 280/842
7,600,768 B2 10/2009 Chen
D607,521 S 1/2010 Chables et al.
D607,524 S 1/2010 Marciano
D608,851 S 1/2010 Hillman
D614,714 S 4/2010 Walworth
7,766,351 B2 8/2010 Chen et al.
7,775,534 B2 8/2010 Chen et al.
D623,701 S 9/2010 Dalgaard et al.
D623,702 S 9/2010 Dalgaard et al.
7,867,050 B2 1/2011 Crispin
7,891,680 B2 2/2011 Chen et al.
D638,494 S 5/2011 Scolari et al.
8,047,556 B2 11/2011 Jang et al.
8,061,725 B1 11/2011 Hawkins
8,118,319 B2 2/2012 Hsieh
D655,772 S 3/2012 Bin
8,157,274 B2 4/2012 Chen
D667,382 S 9/2012 Cosentino
D673,233 S 12/2012 Baggett
8,360,475 B2 1/2013 Cristiano
8,408,565 B2 4/2013 An
8,414,000 B2 4/2013 Chen
8,469,376 B2 6/2013 Kristiansen
D692,079 S 10/2013 Mackay
D692,080 S 10/2013 Hamborg et al.
8,632,084 B2 1/2014 Lovley, II et al.
D698,881 S 2/2014 Hamborg
D699,803 S 2/2014 Yamabe
D705,372 S 5/2014 Harris
8,720,916 B2 5/2014 Bermal
8,857,831 B1 10/2014 Rotondo
8,864,152 B1 10/2014 Danze
8,915,506 B2 12/2014 Piaceski et al.

(56) References Cited

U.S. PATENT DOCUMENTS

| | | | | |
|---|---|---|---|---|
| 8,936,263 | B2 * | 1/2015 | Rawlins | A63C 17/0093 280/87.042 |
| D724,166 | S | 3/2015 | Hamborg et al. | |
| D728,048 | S | 4/2015 | Stover | |
| 9,010,778 | B1 | 4/2015 | Burns | |
| D739,906 | S | 9/2015 | Chen | |
| D743,381 | S | 11/2015 | Pi et al. | |
| 9,186,570 | B1 | 11/2015 | Wells | |
| 9,302,173 | B2 | 4/2016 | DiCarlo | |
| 9,393,481 | B2 | 7/2016 | Fournier | |
| D770,585 | S | 11/2016 | Desberg | |
| 9,492,731 | B2 | 11/2016 | Marusiak et al. | |
| D785,115 | S | 4/2017 | Ying | |
| D789,366 | S | 6/2017 | Jentz et al. | |
| D790,015 | S | 6/2017 | Tan | |
| 9,682,309 | B2 | 6/2017 | Huang | |
| D792,931 | S | 7/2017 | Desberg | |
| D799,450 | S | 10/2017 | Lee et al. | |
| 9,795,864 | B1 | 10/2017 | Bao | |
| 9,975,035 | B1 | 5/2018 | Wang | |
| 10,022,615 | B2 | 7/2018 | Huang | |
| 10,022,616 | B1 | 7/2018 | Consol | |
| D827,748 | S | 9/2018 | Desberg | |
| D829,838 | S | 10/2018 | Huang | |
| D865,096 | S | 10/2019 | Desberg | |
| 10,486,052 | B2 | 11/2019 | Choi | |
| D871,532 | S | 12/2019 | Huang | |
| 10,625,830 | B2 | 4/2020 | Lenchner et al. | |
| 10,709,960 | B2 | 7/2020 | Huang | |
| 10,787,218 | B2 | 9/2020 | Wen | |
| D899,543 | S | 10/2020 | Desberg | |
| D911,476 | S | 2/2021 | Huang | |
| D920,197 | S | 5/2021 | Wan | |
| D940,805 | S | 1/2022 | Desberg | |
| D942,572 | S | 2/2022 | Huang | |
| 11,273,363 | B1 | 3/2022 | Degraff | |
| 11,446,562 | B2 | 9/2022 | Desberg | |
| 11,478,693 | B2 | 10/2022 | Huang | |
| 11,844,998 | B2 | 12/2023 | Desberg | |
| D1,012,217 | S | 1/2024 | Huang | |
| 2002/0043774 | A1 | 4/2002 | Chou | |
| 2002/0067015 | A1 | 6/2002 | Tierney et al. | |
| 2002/0149166 | A1 | 10/2002 | Potter | |
| 2002/0195788 | A1 | 12/2002 | Tiemey et al. | |
| 2003/0124923 | A1 | 7/2003 | Mercer | |
| 2003/0141688 | A1 | 7/2003 | Lynn | |
| 2003/0155725 | A1 | 8/2003 | Roderick | |
| 2003/0155733 | A1 | 8/2003 | Tan et al. | |
| 2004/0021281 | A1 | 2/2004 | Stephens | |
| 2004/0144582 | A1 | 7/2004 | Baker et al. | |
| 2004/0163867 | A1 | 8/2004 | Hillman | |
| 2004/0212160 | A1 | 10/2004 | Roderick | |
| 2004/0262872 | A1 | 12/2004 | Kang | |
| 2005/0160902 | A1 | 7/2005 | Iwai et al. | |
| 2006/0032682 | A1 | 2/2006 | Hillman | |
| 2006/0032685 | A1 | 2/2006 | Koide | |
| 2006/0038361 | A1 | 2/2006 | Sano | |
| 2006/0049595 | A1 | 3/2006 | Crigler | |
| 2006/0055135 | A1 | 3/2006 | Tracewell et al. | |
| 2006/0055137 | A1 | 3/2006 | Jiang | |
| 2006/0163830 | A1 | 7/2006 | Kwak | |
| 2007/0001414 | A1 | 1/2007 | Kang | |
| 2007/0035102 | A1 | 2/2007 | McClain | |
| 2007/0132199 | A1 | 6/2007 | Smith | |
| 2007/0252355 | A1 | 11/2007 | Chen et al. | |
| 2007/0257459 | A1 | 11/2007 | Gang | |
| 2007/0272465 | A1 | 11/2007 | Su | |
| 2007/0273118 | A1 | 11/2007 | Conrad | |
| 2007/0296164 | A1 | 12/2007 | Roderick | |
| 2009/0045598 | A1 | 2/2009 | Lee | |
| 2009/0058028 | A1 * | 3/2009 | Chen | A63C 17/0033 280/87.042 |
| 2009/0134591 | A1 | 5/2009 | Chen et al. | |
| 2009/0206571 | A1 | 8/2009 | Francom et al. | |
| 2009/0270002 | A1 | 10/2009 | Crispin | |
| 2009/0295111 | A1 | 12/2009 | O'Rourke | |
| 2010/0222941 | A1 | 9/2010 | Chang | |
| 2010/0225080 | A1 | 9/2010 | Smith | |
| 2010/0253027 | A1 | 10/2010 | Chen et al. | |
| 2011/0006497 | A1 | 1/2011 | Chen et al. | |
| 2011/0037238 | A1 | 2/2011 | Devine | |
| 2011/0127740 | A1 | 6/2011 | Yamabe | |
| 2011/0133420 | A1 * | 6/2011 | Smith | A63C 17/014 280/87.042 |
| 2011/0187069 | A1 | 8/2011 | Marcel | |
| 2012/0091677 | A1 * | 4/2012 | Wu | A63C 17/0033 403/26 |
| 2012/0125807 | A1 * | 5/2012 | Jones | B65D 77/042 206/583 |
| 2012/0187648 | A1 * | 7/2012 | Chen | A63C 17/0033 280/87.042 |
| 2013/0001910 | A1 | 1/2013 | Hsu | |
| 2013/0168936 | A1 | 7/2013 | Morita | |
| 2013/0277939 | A1 | 10/2013 | Yamabe | |
| 2014/0210175 | A1 | 7/2014 | Hsu | |
| 2015/0160902 | A1 | 6/2015 | Tsujita | |
| 2015/0202526 | A1 * | 7/2015 | Rawlins | A63C 17/265 280/87.042 |
| 2016/0332062 | A1 | 11/2016 | Wu et al. | |
| 2017/0056756 | A1 | 3/2017 | Pikulski | |
| 2017/0151489 | A1 | 6/2017 | Kim | |
| 2018/0273129 | A1 | 9/2018 | Baron | |
| 2018/0296907 | A1 | 10/2018 | Huang | |
| 2018/0318698 | A1 | 11/2018 | Ji | |
| 2018/0361226 | A1 | 12/2018 | Cho | |
| 2019/0070486 | A1 | 3/2019 | Shi | |
| 2020/0282296 | A1 | 9/2020 | Chen et al. | |
| 2020/0346099 | A1 | 11/2020 | Li | |
| 2022/0096913 | A1 | 3/2022 | Chen et al. | |
| 2023/0130257 | A1 | 4/2023 | Huang | |
| 2023/0134906 | A1 | 5/2023 | Desberg | |

FOREIGN PATENT DOCUMENTS

| | | | |
|---|---|---|---|
| CN | 101309730 | | 11/2008 |
| CN | 201205442 | | 3/2009 |
| CN | 201482126 | U | 5/2010 |
| CN | 201505425 | U | 6/2010 |
| CN | 202070117 | U | 12/2011 |
| CN | 206183946 | | 5/2017 |
| CN | 207157383 | U | 3/2018 |
| CN | 304695609 | S | 6/2018 |
| CN | 207667107 | U | 7/2018 |
| CN | 214209406 | U | 9/2021 |
| DE | 202008012754 | | 1/2009 |
| DK | 176806 | | 10/2009 |
| EP | 1511541 | | 3/2005 |
| EP | 1679101 | | 7/2006 |
| GB | 2318519 | | 4/1998 |
| GB | 2464676 | | 4/2010 |
| JP | H0I-117385 | U | 8/1989 |
| JP | H10-211313 | | 8/1998 |
| JP | 2000-500369 | | 1/2000 |
| JP | 2001-029663 | | 2/2001 |
| JP | 2005-537820 | | 12/2005 |
| JP | A 2015-527908 | | 9/2015 |
| KR | 10 20050060368 | | 6/2005 |
| KR | 200 400 315 | Y1 | 11/2005 |
| KR | 200 410 530 | Y1 | 3/2006 |
| KR | 10-2007-0047491 | | 5/2007 |
| KR | 10-2007-0098467 | | 10/2007 |
| KR | 20090003996 | U | 4/2009 |
| KR | 10-0921839 | | 10/2009 |
| KR | 10-20010110239 | | 12/2011 |
| KR | 20120000804 | U | 2/2012 |
| KR | 200462622 | Y1 | 9/2012 |
| KR | 200465548 | Y1 | 2/2013 |
| KR | 20160002496 | A | 1/2016 |
| SU | 1405865 | | 4/1986 |
| TW | 247446 | | 5/1995 |
| TW | 266104 | | 12/1995 |
| TW | M427179 | U | 4/2012 |
| TW | M481045 | U | 7/2014 |

(56) References Cited

FOREIGN PATENT DOCUMENTS

| | | | |
|---|---|---|---|
| TW | M560326 | U | 5/2018 |
| WO | WO 1993/01870 | | 2/1993 |
| WO | WO 1997/018865 | | 5/1997 |
| WO | WO 1999/39787 | | 8/1999 |
| WO | WO 2002/040116 | | 5/2002 |
| WO | WO 2003/092831 | | 11/2003 |
| WO | WO 2004/105901 | | 12/2004 |
| WO | WO 2006/022472 | | 3/2006 |
| WO | WO 2007/102645 | | 9/2007 |
| WO | WO 2007/111466 | | 10/2007 |
| WO | WO 2007/117092 | | 10/2007 |
| WO | WO 2007/127554 | | 11/2007 |
| WO | WO 2007/139356 | | 12/2007 |
| WO | WO 2009/036074 | | 3/2009 |
| WO | WO 2009/100722 | | 8/2009 |
| WO | WO 2009/128586 | | 10/2009 |
| WO | WO 2010/019627 | | 2/2010 |
| WO | WO 2012/083950 | | 6/2012 |
| WO | WO 2013/012129 | A1 | 1/2013 |
| WO | WO 2014/009760 | | 1/2014 |
| WO | WO 2016/086066 | A1 | 6/2016 |
| WO | WO 2016/094806 | A1 | 6/2016 |
| WO | WO 2018/195103 | | 10/2018 |
| WO | WO 2020/181093 | | 9/2020 |
| WO | WO 2021/055852 | | 3/2021 |
| WO | WO 2022/072367 | A1 | 4/2022 |
| WO | WO 2023/056340 | A1 | 4/2023 |

OTHER PUBLICATIONS

"About: Skateboarding; The Wave" http://skateboard.about.com/cs/fringeboarding/gr/XBoard.html; Jan. 2007, in 2 pages.

Micelle' Electric Wave Board [XinCheJian], URL-http://xinchejian.com/2011/05/07/miclles-electric-wave-board/; May 2011, in 6 pages.

The Wave, Streetsurfing, http://www.streetsurfing.com/wave/skating.html; Mar. 2007, in 2 pages.

Invitation to Pay Additional Search Fees in corresponding International Patent Application No. PCT/US2022/077237, dated Nov. 18, 2022, in 2 pages.

International Search Report and Written Opinion in corresponding International Patent Application No. PCT/US2022/077237, dated Jan. 27, 2023, in 13 pages.

* cited by examiner

PERSONAL MOBILITY VEHICLES WITH ADJUSTABLE WHEEL POSITIONS

INCORPORATION BY REFERENCE TO ANY PRIORITY APPLICATIONS

This application is based upon and claims the benefit of priority from U.S. Provisional Patent Application No. 63/261,935 filed on Sep. 30, 2021 and U.S. Provisional Patent Application No. 63/263,438 filed on Nov. 2, 2021. Moreover, any and all applications for which a foreign or domestic priority claim is identified in the Application Data Sheet as filed with the present application are hereby incorporated by reference under 37 CFR 1.57. The entire contents of each of the above-listed items is hereby incorporated into this document by reference and made a part of this specification for all purposes, for all that each contains.

BACKGROUND

Personal mobility vehicles have many aspects available for improvement. There is a need for devices that allow for simple and secure replacement and adjustment of wheels, for example.

SUMMARY OF CERTAIN ASPECTS

The present disclosure relates to personal mobility vehicles, such as casterboards, skateboards, scooters, drift carts, go carts, or otherwise. In particular, the present disclosure relates to vehicles with wheels that can be adjusted to varying positions. This can enable the wheel location and stance to be customized, such as to accommodate a user's personal preferences, to enable different riding characteristics, to facilitate various tricks, to provide for replacement of worn parts, to upgrade to motorized or otherwise improved components, and/or otherwise.

In some embodiments, the wheel length is adjustable. "Wheel length" is the front-to-rear distance between the centers of a front wheel and a rear wheel. In some embodiments, the wheel width is adjustable. "Wheel width" is the side-to-side distance between the centers of two front wheels and/or between two rear wheels.

In some embodiments, a casterboard can comprise a deck configured to support a user, a front caster wheel, a rear caster wheel, and a wheel lock. At least one of the front caster wheel and the rear caster wheel comprises a movable wheel that is configured to translate from a first position to a second position relative to the deck. The wheel lock can be configured to secure the movable wheel in the first and the second positions.

In some embodiments, the movable wheel can be configured to translate along a track in the deck. In some embodiments, the casterboard can further comprise an access region configured to enable the movable wheel to be removed from the deck. In some embodiments, the movable wheel is configured to translate in a direction that is generally parallel to a longitudinal axis of the vehicle. In some embodiments, the wheel lock comprises a latch on the movable wheel and a plurality of openings in the deck. The wheel lock can comprise a set screw. The movable wheel can be motorized. The front caster wheel can be the movable wheel. The rear caster wheel can be the movable wheel. In some embodiments, the casterboard can further comprise a neck portion that is narrower than a front and rear portion of the deck.

In some embodiments, an adjustable wheel mobility vehicle can comprise a support structure configured to support a rider, at least one modular conveying feature comprising a wheel for conveying the rider and the support structure, at least one attachment in the support structure, the attachment configured to physically and/or tightly secure the at least one modular conveying feature to the support structure in at least two different positions, and/or a tool-free mechanism configured to allow a user to free the at least one modular conveying feature from attachment to the support structure for movement between the at least two different positions.

In some embodiments, the vehicle can further comprise a second wheel, wherein movement of the at least one modular conveying feature between the at least two different positions changes a distance between it and the second wheel. In some embodiments, the second wheel can be fixed with respect to the support structure. In some embodiments, the support structure comprises a casterboard deck having two widened portions configured to support two feet and separated by a resilient portion, the attachment in the support structure is located beneath one of the widened portions, and a second wheel is positioned beneath another one of the widened portions. In some embodiments, the attachment comprises multiple holes through a portion of the support structure. In some embodiments, the attachment comprises a longitudinal track and the modular conveying feature comprises a wheel base configured to snugly or tightly fit within the track. In some embodiments, the attachment further comprises a protrusion extending into an opening to secure the modular conveying feature at a particular position within the longitudinal track. In some embodiments, the attachment further comprises edge walls of the wheel base and parallel walls of the longitudinal track that cooperate to prevent rotation of the wheel base. In some embodiments, the wheel base supports a caster wheel for pivoting about a pivot axis for rolling about a rolling axis. In some embodiments, in both of the at least two different positions, the wheel base positions the wheel at a non-perpendicular angle with respect to a principal plane of the support structure and provides a self-centering bias for the wheel. In some embodiments, the vehicle further comprises a wheel position indicator visible from above the support structure and configured to indicate to a rider a present position of the modular conveying feature. In some embodiments, the wheel position indicator comprises a viewing opening in the support structure and a portion of the modular conveying feature. In some embodiments, the tool-free mechanism comprises a wheel lock having resilient protrusions that can be displaced by human user's hand without a tool when repositioning the modular conveying structure between the at least two different positions.

In some embodiments, a system for adjusting a skateboard (or other type of personal mobility vehicle) wheel position can comprise a wheel support structure having multiple wheel attachment positions, and a wheel assembly comprising a wheel (e.g., a skateboard wheel) and a base, the wheel configured to swivel with respect to the base and the base configured to join to the wheel support structure. The base and wheel support structure can comprise complimentary structures that tightly join to prevent rotation of the base with respect to the wheel support structure and that tightly retain the base in a first attachment position. The base and wheel support structure can further comprise a release feature configured to allow a user to easily loosen the base from the first attachment position of the wheel support structure and reposition the base in a second attachment position of the wheel support structure, such that the base is tightly retained in the second attachment position.

In some embodiments, the wheel support structure comprises an elongate opening with at least two vertical walls that are sized to allow the base to slide into the opening while the walls maintain contact with corresponding walls in the base, thereby forming the complimentary structures that tightly join to prevent rotation of the base with respect to the wheel support structure. In some embodiments, the at least two vertical walls have at least two side openings and the base has at least one resilient protrusion that cooperates with the two side openings to form complimentary structures that tightly retain the base in the first attachment position, the resilient protrusion also forming the release feature. In some embodiments, the system further comprises a skateboard or casterboard deck configured to position the wheel support structure on its underside such that at least two wheels are provided to support the deck when in use. In some embodiments, the release feature comprises at least one resilient tab lock that can be displaced and unlocked by a user's fingers.

In some embodiments, a compact kit for assembling a skateboard or casterboard can comprise a deck, a securement module having multiple wheel bays, and at least one wheel assembly having a base configured for insertion into the multiple wheel bays. The kit can comprise a package that efficiently positions the deck, the securement module, and the at least one wheel assembly generally within the same plane to form a flat pack. In some embodiments, the kit can further comprise a second securement module having a bay and a second wheel assembly having a base configured for insertion into the bay of the second securement module, the package further configured to position the second securement module and the second wheel assembly generally within the same plane to form the flat pack.

Neither the preceding Summary nor the following Detailed Description purports to limit or define the scope of protection. The scope of protection is defined by the claims.

BRIEF DESCRIPTION OF THE DRAWINGS

The abovementioned and other features of the embodiments disclosed herein are described below with reference to the drawings of the embodiments. The illustrated embodiments are intended to illustrate, but not to limit, the scope of protection. Various features of the different disclosed embodiments can be combined to form further embodiments, which are part of this disclosure.

DETAILED DESCRIPTION OF CERTAIN EMBODIMENTS

Figure 1:
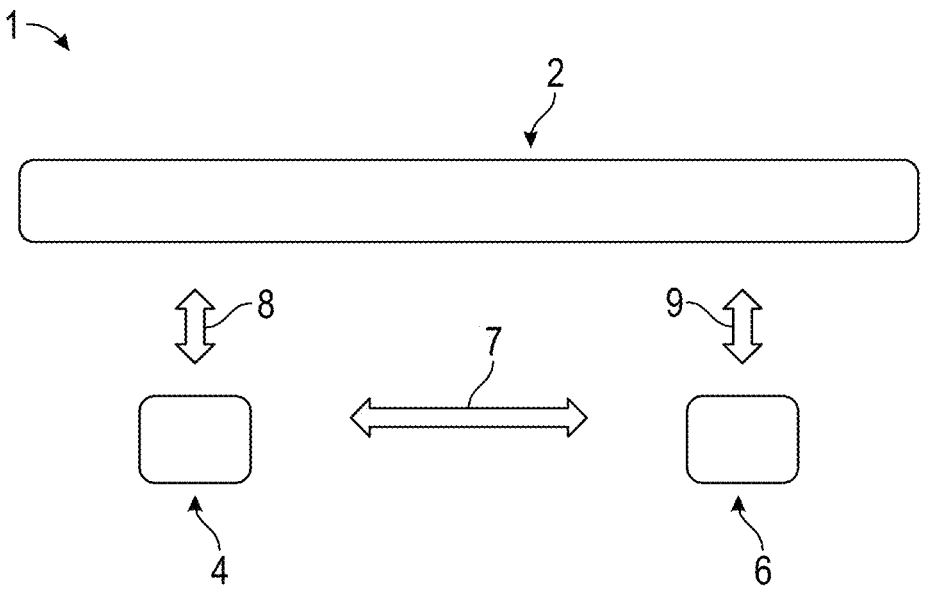
FIG. 1 schematically illustrates a mobility vehicle having modules that can be a support surface and one or more connectable and/or adjustable conveying features.

Although certain preferred embodiments and examples are disclosed below, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

This specification provides textual descriptions and illustrations of many devices, components, assemblies, and subassemblies. Any structure, material, function, method, or step that is described and/or illustrated in one example can be used by itself or with or instead of any structure, material, function, method, or step that is described and/or illustrated in another example or used in this field. The text and drawings merely provide examples and should not be interpreted as limiting or exclusive. No feature disclosed in this application is considered critical or indispensable. The relative sizes and proportions of the components illustrated in the drawings form part of the supporting disclosure of this specification, but should not be considered to limit any claim unless recited in such claim.

Various embodiments of vehicles with wheels that can be replaced, secured, decoupled, updated, and/or adjusted to various positions are disclosed. The present disclosure describes certain embodiments in the context of a casterboard due to particular utility in that context. However, the subject matter of the present disclosure can be used in many other contexts as well (such as scooters, skateboards, carts, or other personal mobility vehicles) and is not limited to the embodiments illustrated in the drawings. The present technology can be implemented in powered or manually operated vehicles.

Throughout the drawings, the particular shape and size of the elements illustrated may be exaggerated or otherwise vary from a particular implementation of this disclosure in order to communicate certain aspects of this disclosure.

FIG. 1 schematically illustrates a mobility vehicle having modules that can be a support structure and one or more connectable and/or adjustable conveying features. For example, a conveyance 1 can include a support structure 2 and modular conveying features 4 and 6. These features can have different separations 7 between them. They can detach and attach, as shown by bi-directional arrow 8 and 9, to the support structure 2 at different positions. Preferably, such attachments do not require tools and provide secure, strong and rigid support for swiveling and rotating wheels to perform properly under rigorous skating conditions.

Example Embodiment

Figure 2A:
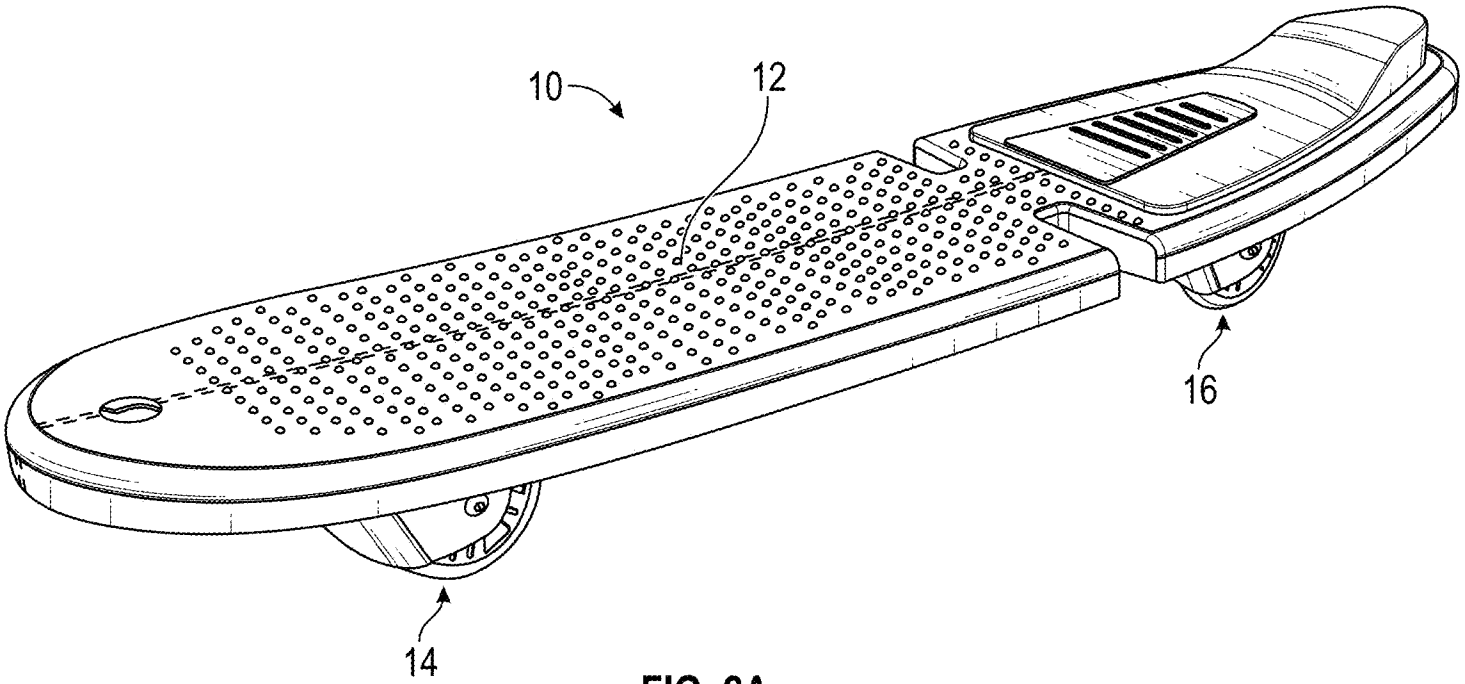
FIG. 2A illustrates a top front perspective view of an embodiment of a casterboard with adjustable wheel positions.
Figure 2B:
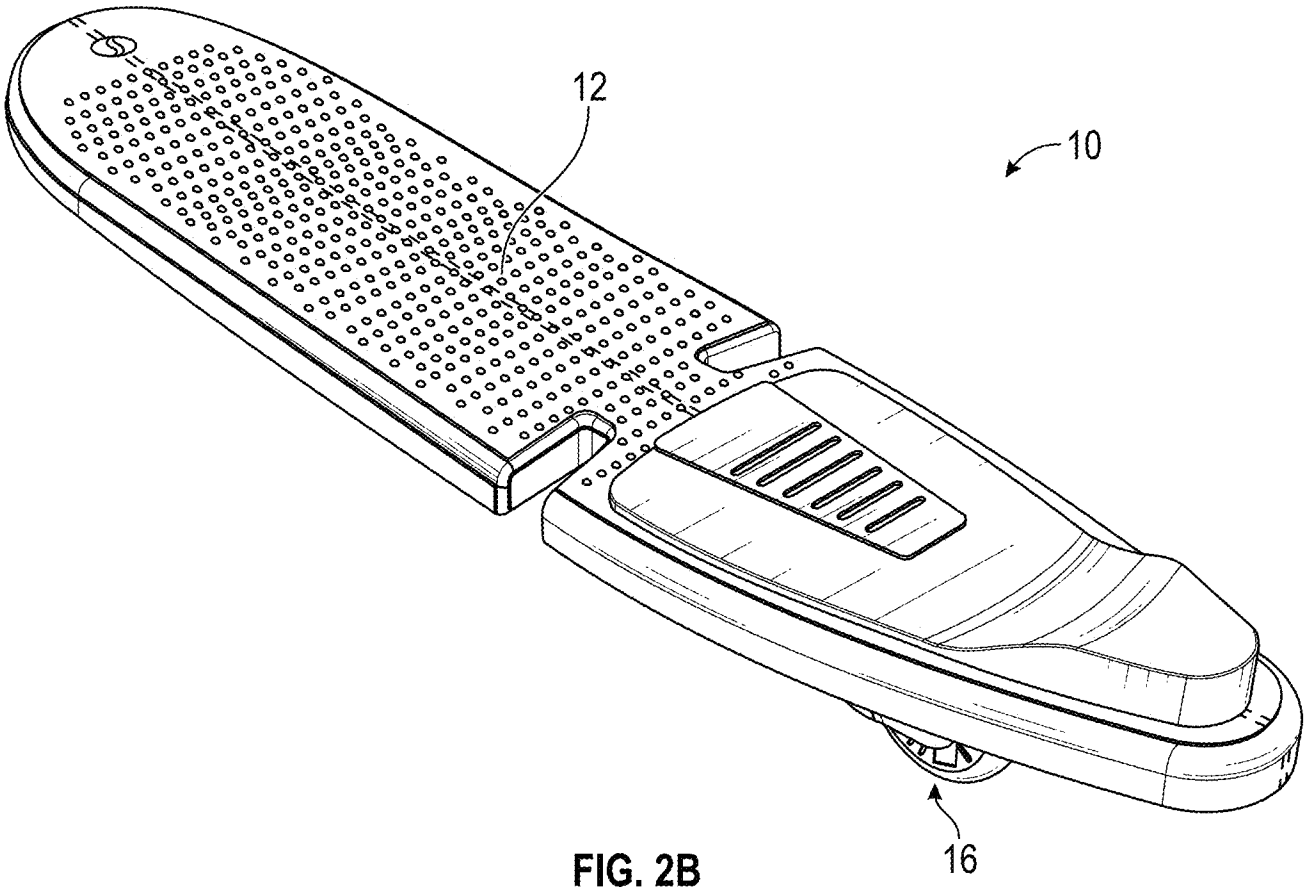
FIG. 2B illustrates a top rear perspective view of the casterboard of FIG. 2A.
Figure 3:
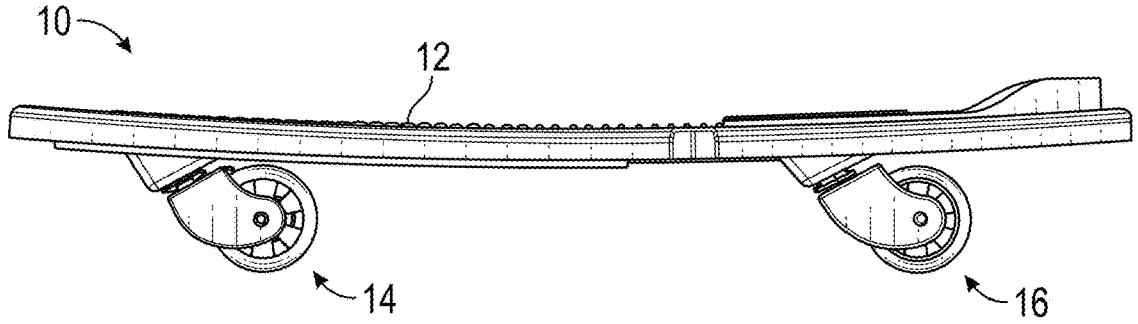
FIG. 3 illustrates a side view of the casterboard of FIGS. 2A and 2B.

FIGS. 2A-3 show different views of a casterboard 10, which can have adjustable wheel positions, consistent with the schematic illustration of FIG. 1. In the perspective view of FIG. 2A, a front wheel 14 and a back wheel 16 is shown. A notched region of the deck 12 can allow torsion and propulsion as front and back portions tilt in opposite directions under pressure from a user's feed, but then tend to resiliently return to a neutral position. This is possible in part because of the tilted wheel configuration shown in FIG. 3, where wheel assemblies connect to the deck 12 through a wedge-shaped base discussed further below.

Figure 4:
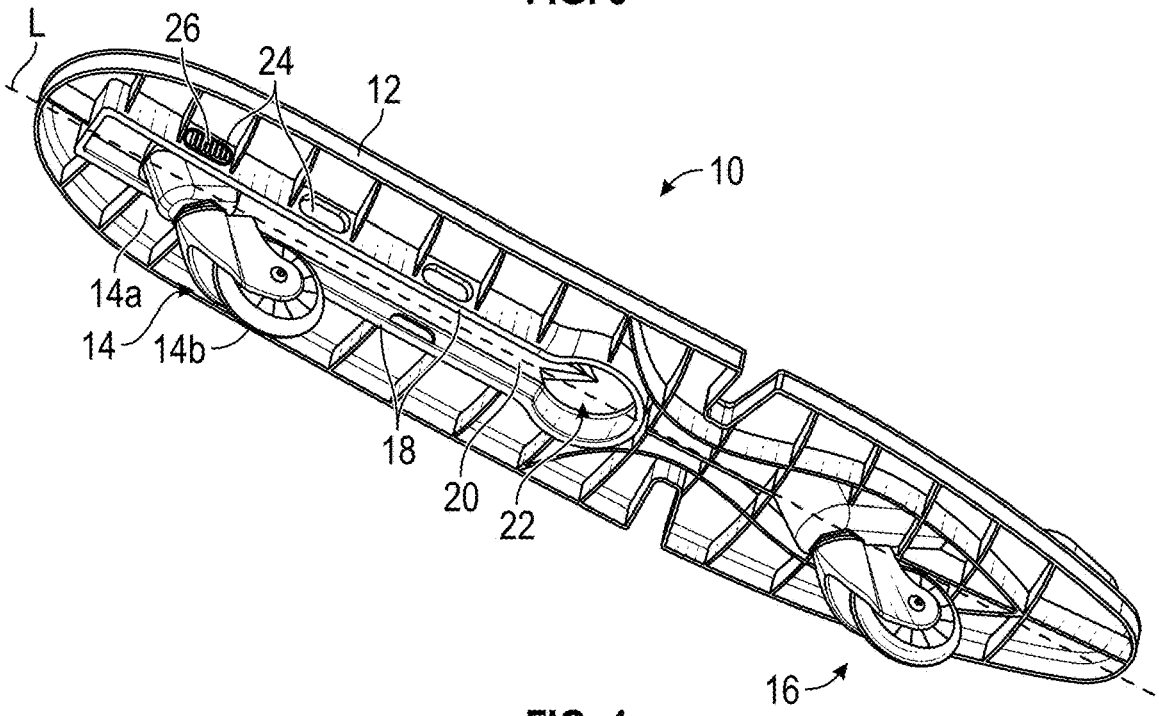
FIGS. 4 and 5 illustrate bottom perspective views of the casterboard of FIGS. 2A-3.

FIG. 4 illustrates a bottom perspective view of a vehicle with one or more wheels that can be adjusted to various positions, consistent with the views in FIGS. 2A-3. The illustrated vehicle is a casterboard 10, though as mentioned above, the present technology can be implemented on other types of vehicles too. The casterboard 10 can include any of the features disclosed in U.S. Pat. Nos. 7,195,259 and 7,338,056, each of which is incorporated by reference herein in its entirety and discussed in more detail below.

The casterboard 10 can include a deck 12 that a rider can stand on. The casterboard can include a neck portion that is narrower than a front and rear portion of the deck. Using this neck as a pivot region, the front and rear positions can be twisted relative to each other to provide locomotion to the vehicle.

The casterboard can include a front wheel 14 and a rear wheel 16. Some embodiments have a plurality of front wheels and/or a plurality of rear wheels. One or more of the wheels 14, 16 can be caster wheels, such that the wheels can roll around a first axis parallel to the deck, while a fork holding the wheels can swivel or spin around a second axis transverse to the deck. The wheel 14 can include a base 14*a* and a rotating portion 14*b*. One or more of the wheels 14, 16 can be motorized.

One or more of the wheels 14, 16 of the casterboard 10 can be configured to move (e.g., translate) relative to the deck 12. Advantageously, any moveable wheel(s) are rigidly and securely positioned during use of the casterboard 10, but can be quickly and readily repositioned by a user. For example, in the example illustrated in FIGS. 4 and 5, the front wheel 14 can slide (or be repositioned linearly) relative to the deck 12 from a first position to a second position. The base 14*a* of the wheel 14 can slide or be repositioned along one or more rails 18 and/or in a track 20. In some embodiments, the movable wheel can be moved in a direction generally parallel to a longitudinal centerline axis L of the vehicle. This can facilitate adjustment of the wheel length, or distance between wheels. Wheel length can be a property of a casterboard that corresponds to the preferred stance (separation between legs) of a user, such that each foot is placed above one of the wheels. In some embodiments, the movable wheel can move generally parallel to and along a lateral (side-to-side) axis of the vehicle. This can facilitate adjustment of the wheel width. In some embodiments, the rear wheel 16 can slide relative to the deck 12. Certain embodiments include a plurality of front wheels, one or more of which is configured to move (e.g., translate or be repositioned) relative to the deck 12. Some embodiments have a plurality of rear wheels, one or more of which is configured to move (e.g., translate or be repositioned) relative to the deck 12.

In some embodiments, one or more of the wheels 14, 16, can be removed from the deck. For example, in the example illustrated in FIGS. 4 and 5, the front wheel 14 can be slid into an access region 22. When in the access region 22, the wheel can be removed from the deck. This can enable the user to replace a wheel that has become worn or to change the wheel type (e.g., material type, wheel width, motorized or non-motorized, etc.). The ability to replace a wheel can facilitate enhanced riding time and/or performance. For example, in certain embodiments, the wheel includes a power supply (e.g., a battery), so the ability to replace the wheel can enable the user to swap an expended powered wheel with a fresh powered wheel. This may include, for example, sliding a wheel in which the power supply has been expended to the access region and removing such a wheel, then installing a wheel for which the power supply is charged into the access region and moving such a wheel to a desired location on the vehicle (e.g., along the track 20).

In various embodiments, the movable wheel (or wheels) can be secured in a desired position on the vehicle with a wheel lock. A variety of wheel locks are contemplated. For example, in the embodiment illustrated in FIGS. 4 and 5, the front wheel can be slid to a desired location and locked in place. Such a slide and lock mechanism can include an opening 24 in downward-extending walls of a track 20 on the deck and a latch 26 (e.g., a protrusion, detent, etc.) on the wheel or a supporting structure for the wheel. Alternatively, a protrusion can extend from the track 20 into an opening in the wheel or a supporting structure thereof (e.g., 14*a*). The latch 26 can be engaged with (e.g., received in) the opening 24 to secure the wheel in position relative to the track 20 and the deck 12. The latch 26 can be disengaged from (e.g., not in physical interference with) the opening 24 to enable to wheel to move relative to the deck 12. This can be accomplished by a user pushing in on the latch 26, for example, to proactively move the wheel 14. The latch 26 can be biased, such as with a spring, toward engagement with the opening 24 such when the casterboard 10 is being ridden, the wheel 14 is safely fixed with respect to the deck 12 and the track 20. The user can press the latch 26 (e.g., inwardly and/or toward the longitudinal centerline L) to release the latch 26 from the opening 24. In some implementations, the wheel lock comprises a fastener (e.g., bolt, pin, etc.) that can be engaged in holes in the deck to secure the wheel in various positions. In certain variants, the wheel lock comprises a set screw, cotter pin, etc.

Figure 5:
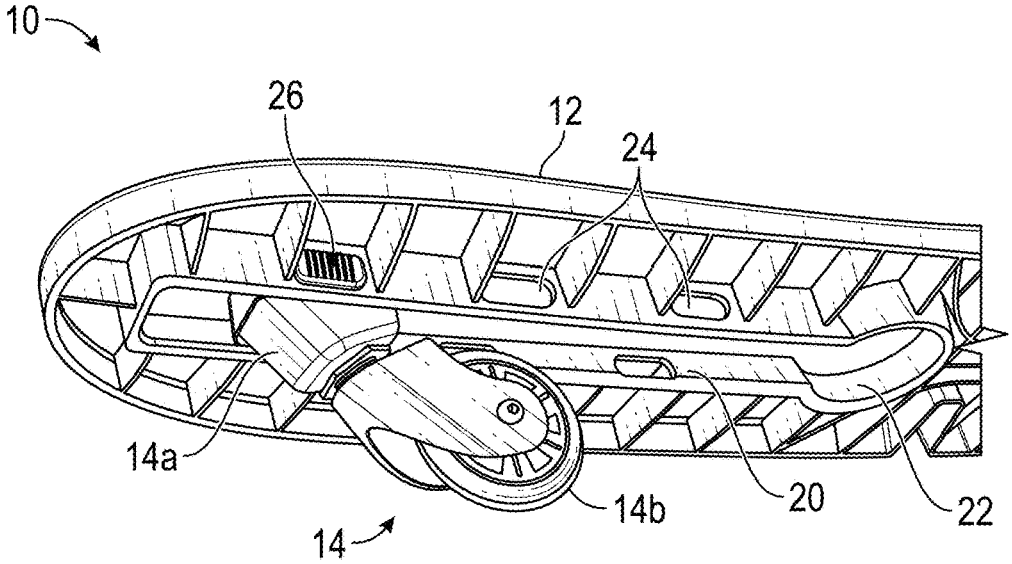

As shown in FIG. 5, an underside of a casterboard 10 can include numerous ribs for providing structural rigidity and strength, while maintaining a light weight for such a board. The deck 12 can thus be advantageously formed from plastic in a molding process. The ribs can connect an edge lip of the deck 12 with a downwardly-extending wall of the track 20, but the ribs can leave the track 20 open to permit sliding of a base 14*a* (and any depressed securement structures such as a latch 26) within the track 20 during a repositioning. This figure also shows how a rotating portion 14*b* can be joined to a base 14*a* to form a wheel 14. The wheel 14 can thus former a modular, removable and positionable unit. Here, at least a portion of the wheel 14 (e.g., a fork structure supporting an axle passing through a rotating portion 14*b*) is formed from metal and at least a portion of the base 14*a* is formed from plastic.

Additional Example Embodiments. FIGS. 6A-7C illustrate additional embodiments of a vehicle (e.g., a casterboard 100) with one or more wheels that can be adjusted to various positions. The casterboard 100 can have any of the features of the casterboard 10. The casterboard 100 can include a deck 112 that the user can stand on. The illustrated deck 112 has the appearance of a small surfboard, though other implementations have other shapes.

Figure 6A:
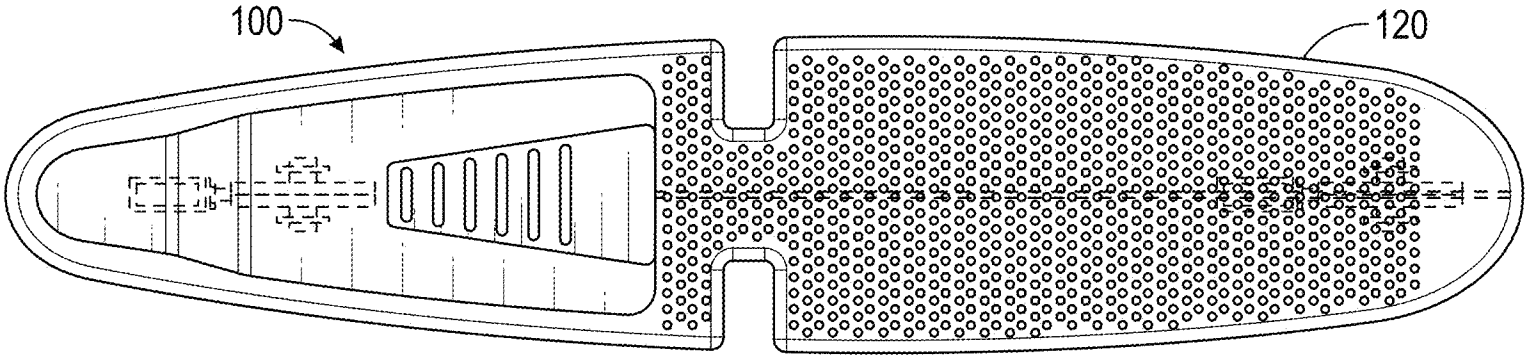
FIGS. 6A-6B illustrate top and side views of a casterboard with adjustable wheel positions.
Figure 6B:
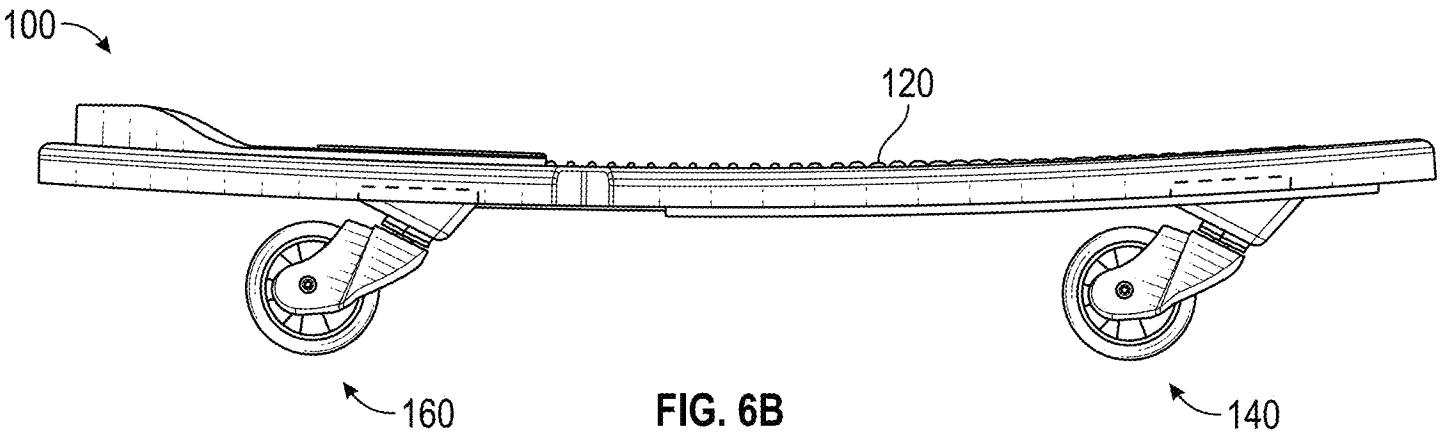
Figure 6C:
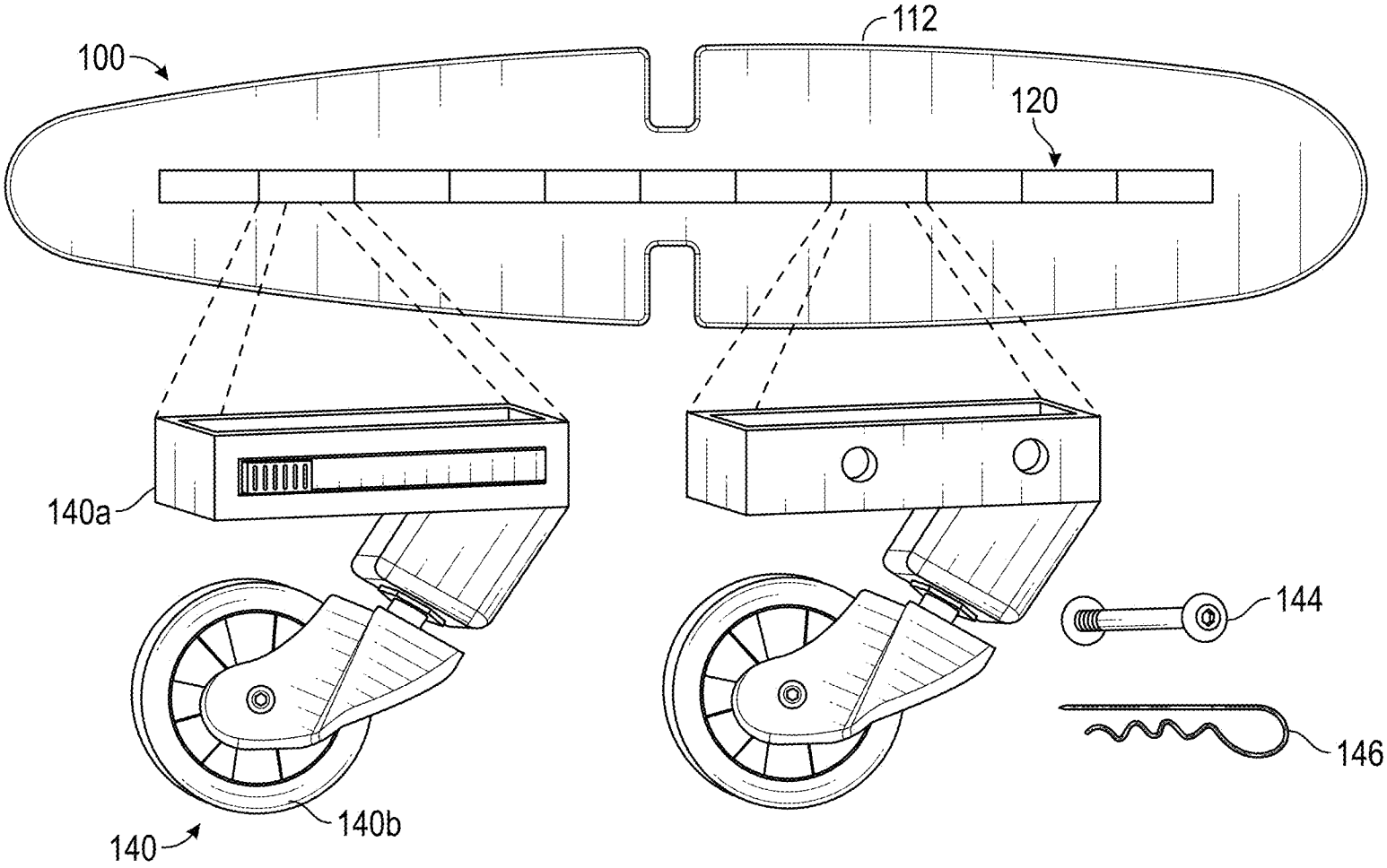
FIG. 6C shows how, in the context of FIGS. 6A and 6B, a deck can have a track and removable wheel cartridges can engage the track.
Figure 7A:
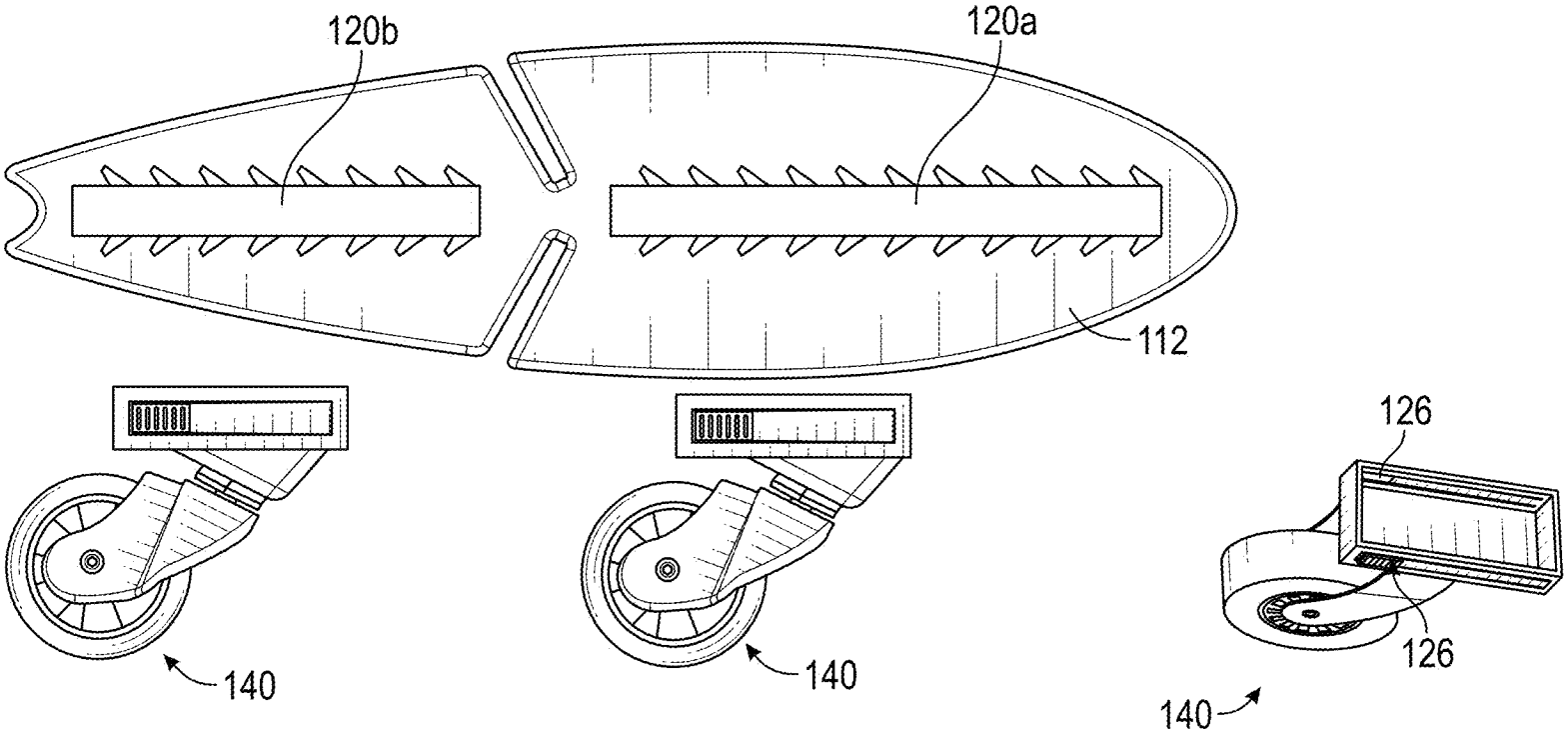
FIG. 7A shows a casterboard with tracks and associated wheel cartridges.

The casterboard 100 can have a track 120 on the bottom of the deck 112. In some embodiments, the track 120 comprises an elongate channel, such as a slot, recess, or groove. The track 120 can be generally parallel to and/or on a longitudinal line (e.g., centerline) of the casterboard 100. The track 120 can be integrated into the bottom of the deck 112, such as being unitarily formed with the deck 112. In some embodiments, the track 120 is a separate component that is connected to the deck. For example, the track 120 can comprise a strong and rigid (e.g., metal) channel secured or securable to the bottom of the deck. As shown in FIG. 7A, the deck 112 can include a front portion and a rear portion and corresponding front and rear tracks 120*a*, 120*b*. The track 120 can have a plurality of openings 124, such as recesses or through-holes. In some variants, the track 120 comprises a series of discrete mounting locations. The openings 124 can open laterally and/or toward the sides of the deck 112 and be configured to receive corresponding protrusions from a wheel base 140*a*. Alternatively or additionally, a track can include protrusions corresponding to openings in a wheel base 140*a*. Alternatively or additionally, as shown in FIG. 6C, both the track 120 and the base 140*a* can include openings and a bolt 144, shaft, cotter pin 146, etc. can extend through the openings to secure the base 140*a* in place with respect to the deck 112 (e.g., within a track 120).

The casterboard 100 can have a wheel cartridge 140 (and another wheel 160, in some examples). As shown in FIG. 6C, for example, the wheel cartridge 140 can include a base 140*a* and a caster wheel 140*b*, such as an inclined caster wheel. An inclined caster wheel is further described with respect to FIG. 10. In some implementations, the caster angle is adjustable, for example, by positioning a wheel cartridge 140 at different angles or using differently-oriented openings to accept tabs 126. As shown in FIG. 7A, certain implementations have multiple wheel cartridges 140. For example, in some embodiments with front and rear tracks 120*a*, 120*b*, the casterboard 100 can include corresponding front and rear wheel cartridges. Certain embodiments have a plurality of wheel cartridges 140 on the front end of the deck 112 and/or a plurality of wheel cartridges 140 on the rear end of the deck 112.

The wheel cartridge 140 and the track 120 can matingly engage. In some embodiments, the wheel cartridge 140 is a male element and the track 120 is a female element. For example, in the embodiment illustrated, the wheel cartridge 140 comprises the base 140*a* and the track 120 comprises a channel that at least partially receives the base 140*a*. In some variants, the wheel cartridge 140 is a female element and the track 120 is a male element. For example, the track 120 can comprise a rail and the wheel cartridge 140 can comprise a channel that receives the rail. In some implementations, the wheel cartridge 140 can be installed in or on the track 120 in only a single orientation. In certain variants, the wheel cartridge 140 can be installed in the track 120 in multiple orientations, such as a forward cant and reverse cant orientation.

The wheel cartridge 140 can be repositionable relative to the track 120. For example, the wheel cartridge 140 can be configured to slide and/or translate along the track 120 (preferably only when specifically translated by a user, when the casterboard is not being ridden). In some embodiments, the wheel cartridge 140 can be repositioned along the track 120 while remaining engaged with the track 120 and/or without needing to remove the wheel cartridge 140 from the track 120. In some variants, the wheel cartridge 140 ratchets and/or is permitted to slide in only one direction relative to the track 120. The casterboard 100 can include a variety of mechanisms that permit adjustment of the wheel cartridge 140 position and/or that secure the wheel cartridge 140 in place relative to the deck 112, as discussed below.

In some embodiments, the wheel cartridge 140 can be moved relative to, installed onto, and/or removed from the deck without tools. For example, in some embodiments, the wheel cartridge 140 can be released (e.g., loosened), moved, and secured (e.g., tightened) without the need for tools. Some implementations use tools (such as a screwdriver, wrench, or otherwise) to adjust the position and/or securement of the wheel cartridge 140.

The wheel cartridge 140 can include a lock mechanism. The lock mechanism can be configured to secure (e.g., connect, tighten and/or cinch) the wheel cartridge 140 to the track 120. The lock mechanism comprises, for example, one or more flexible tabs, push-buttons, pins, bolts, screws, clips, detents, or otherwise. In some embodiments, the lock mechanism includes one or more clamps, such as quick-release clamps.

Figure 7B:
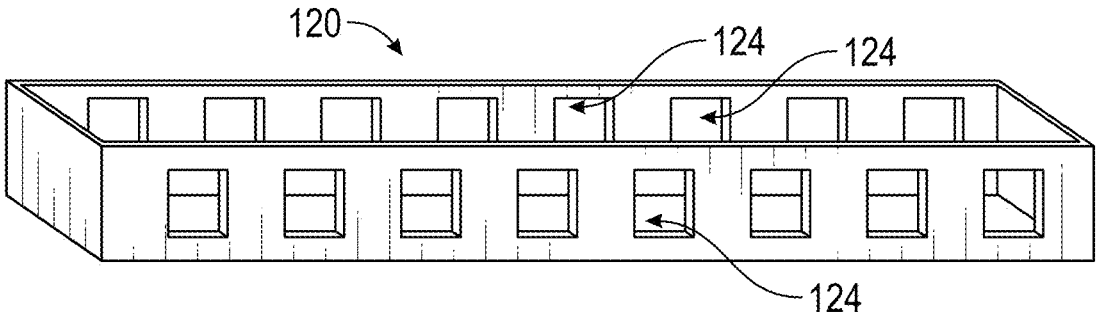
FIGS. 7B-7C show close-up views of a track and a wheel cartridge configured to associate therewith.
Figure 7C:
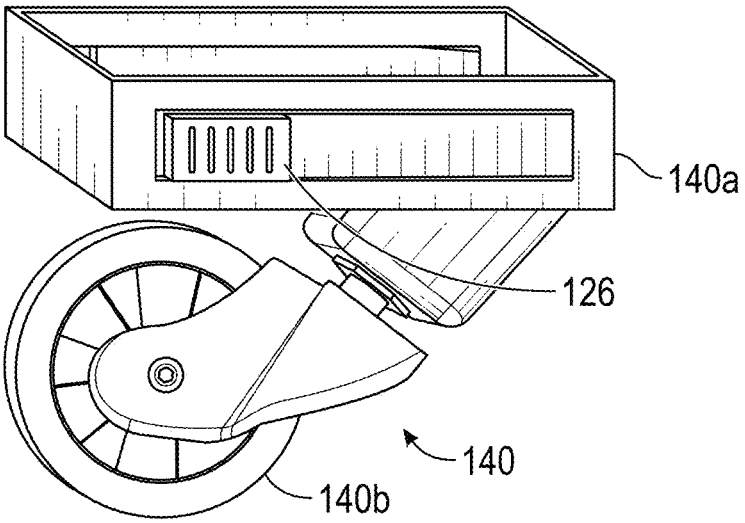

In certain implementations, the lock mechanism includes mating tabs and openings. As illustrated in FIGS. 7C and 7B, for example, the wheel cartridge 140 can include one or more flexible male tabs 126 and the track 120 can include a plurality of openings 124. The openings 124 can receive the tabs 126, thereby providing a physical interference that secures the wheel cartridge 140 in position and/or inhibits or prevents the wheel cartridge 140 from being moved relative to the track 120.

In some variants, the lock mechanism comprises a ratcheting track system. For example, the track 120 can include teeth and the wheel cartridge 140 can include a pawl. The pawl can engage the teeth such that movement of the wheel cartridge 140 along the track 120 is permitted in one direction but substantially not the opposite direction. Movement of the wheel cartridge 140 along the track 120 can produce an audible sound, which can provide notice to the user that the wheel cartridge 140 is being repositioned or moved through a series of potential secure positions.

Figure 8:
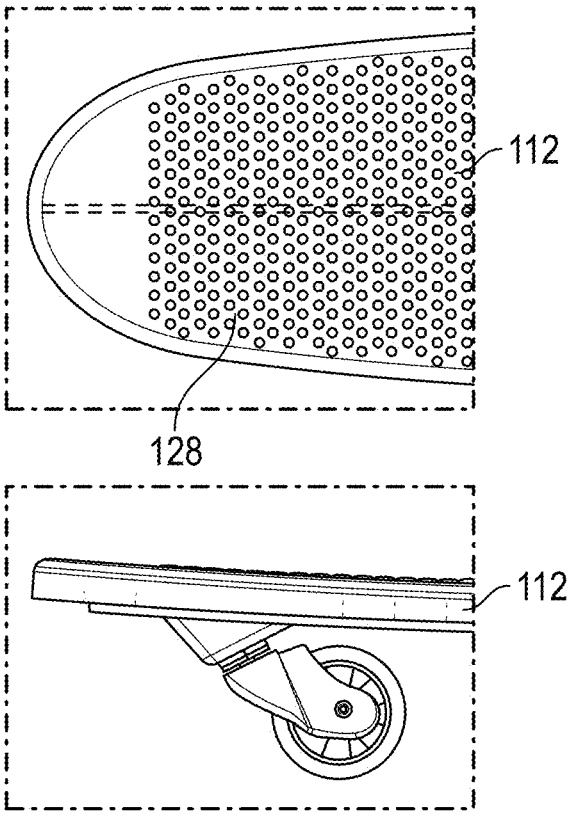
FIG. 8 illustrates schematic bottom and side views of a front portion of a casterboard with holes for adjusting the wheel position.

In some embodiments, the lock mechanism comprises a deck bolt interface or deck style bolt pattern (e.g., as on snowboards or skateboards). One or more bolts that extend through a portion of the wheel cartridge 140 can engage and pass through corresponding holes 128 in the deck 112. In some implementations, the holes 128 are visible from the top or bottom side of the deck 112. As shown in FIG. 8, in certain implementations, the bolts are installed from the top of the deck 112. In some variants, the bolts are installed from the bottom or side of the deck 112, as also shown in FIG. 8.

The lock mechanism can be configured to fail to safe (e.g., to a state that locks the wheel cartridge in position). The lock mechanism can be biased (e.g., by a spring) to engage into one of the openings 124. The lock mechanism can be configured such that a user must apply a force to disengage the lock mechanism to reposition the wheel cartridge 140.

The wheel cartridge 140 can be removable from the track 120. This can enable the casterboard 100 to be customized and/or adjusted, such as to accommodate the user's environment, a user's preferences, and/or a rider's skill level. For example, when the user desires more speed, one or more wheel cartridges 140 with harder wheels can be installed, and/or when the user desires more comfort, one or more wheel cartridges 140 with softer wheels can be installed. As another example, the user can change between larger wheels or forks (e.g., when greater ground clearance is desired) and smaller wheels or forks (e.g., when a lower to the ground ride experience is desired). Further, the user can mix and match wheel cartridges 140 to their preferences, such as a wheel cartridge 140 with a first larger diameter rear wheel and a wheel cartridge 140 with a smaller diameter front wheel.

Removable wheel cartridges 140 can reduce the packaged size of the casterboard 100 (e.g., can decrease box size, can reduce the spacial volume, etc.). In certain embodiments, with the wheel cartridges 140 removed, the casterboard 100 can be flat packed.

In some embodiments, the wheel cartridge 140 has a plurality of wheels, such as a pair of wheels next to each other. This can enable the user to make the casterboard 100 more stable and/or easier to ride (such as to aid a new user in learning to ride the casterboard). When the user's skill has advanced, the user can swap the wheel cartridge having a plurality of wheels with a wheel cartridge that has a single wheel. In some embodiments, the wheel cartridge 140 includes two caster wheels on one cartridge. Certain wheel cartridge 140 can have one, two, three, or more movable caster wheels. To enable such configurations, multiple tracks 120 can be used. Side tracks 120 can be used to position two wheels symmetrically (e.g., not on the center line of a deck 112). A third track 120 can be positioned centrally for when a user graduates from a tri-wheel configuration to a bi-wheel configuration, for example, using the same deck 112.

Figure 9:
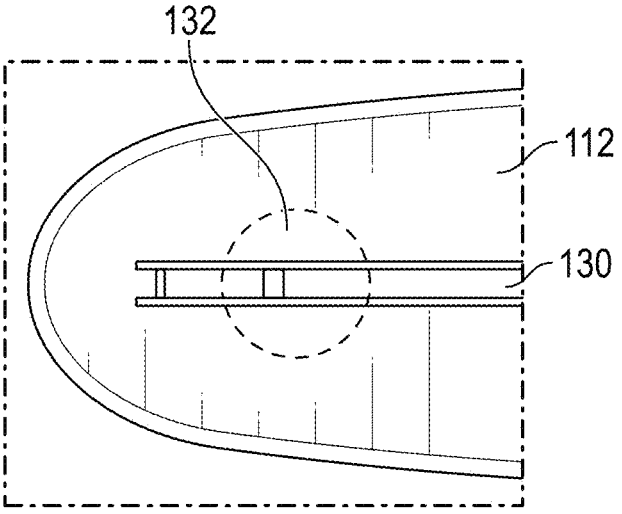
FIG. 9 illustrates a schematic top view of a front portion of a casterboard with adjustable wheel positions with a wheel location indicator.

As shown in FIG. 9, in certain implementations, the casterboard 100 can include an indication system configured to enable a rider to see the position of one or more of the wheel cartridges 140. This can be beneficial in operating the casterboard 100, as the casterboard 100 may become less stable when a user places his or her feet beyond the position of the wheels. By having a visual indication of the location of the wheel cartridge 140, the user can position his or her feet accordingly. The indication system can be configured to indicate the position of the wheel cartridge 140 to a user, even when the user is looking down from above or standing on the deck 112.

In some embodiments, the indication system includes an indicator strip, such as a transparent or translucent portion, in the deck 112. The indicator strip can correspond to the location of and/or extend generally parallel to the track 120. The indication system can include an indicator unit, such as a dark or colored mark, on the wheel cartridge 140. When the wheel cartridge 140 is mounted to the deck, the indicator unit can be visible through the indicator strip.

In some embodiments, the indication system shows the location of fasteners (e.g., bolts) in corresponding holes in the deck 112. For example, the holes can comprise through-holes in the deck 112, which enable the user to see which holes have bolts installed, and thus the location of the wheel cartridge 140. In some implementations, the holes are covered with a protective layer, such as a layer of transparent or translucent plastic, on the top of the deck 112. In some variants, an upper end of the holes is closed, such as with a clear epoxy.

Overview of Skating Board with Direction-Casters

As noted above, U.S. Pat. No. 7,195,259 is incorporated herein. That patent explains that skateboards can have front and rear boards with a connecting element which interconnects the two plates in a spaced relationship. Each board can have one or more than one direction-caster(s) which is mounted on the underside of the plate of at least one of the front board and the rear board using connecting elements that may include an elastic member so that the connecting element can be elastically twisted or bent when it receives twisting force or bending force and it can be restored to its original shape when the force is removed. The front board may have one or more than one direction-caster and the rear board may have one or more than one fixed roller set. The connecting element may be a twist-pipe which has elastic material in it, or it may comprise a narrowed portion of a board that resiliently connects to wider portions of a board as shown in FIGS. 2A, 2B, 4, and 7A, for example. The connecting element may comprise the twist-pipe and two elastic members which are provided parallel to the twist-pipe at both sides of the twist-pipe and are connected to the front board and the rear board at each of their both ends.

With further reference to U.S. Pat. No. 7,195,259, a skating board can have a front board, a rear board and a connecting element which interconnects the two boards in a spaced relationship, wherein at least one of the front board and the rear board has one or more than one direction-caster skate blade which is mounted on the underside of the plate of the front board and the rear board, the connecting element includes an elastic member so that it can be elastically twisted or bent when it receives twisting force or bending force and it can be restored to its original shape when the force is removed.

Figure 10:
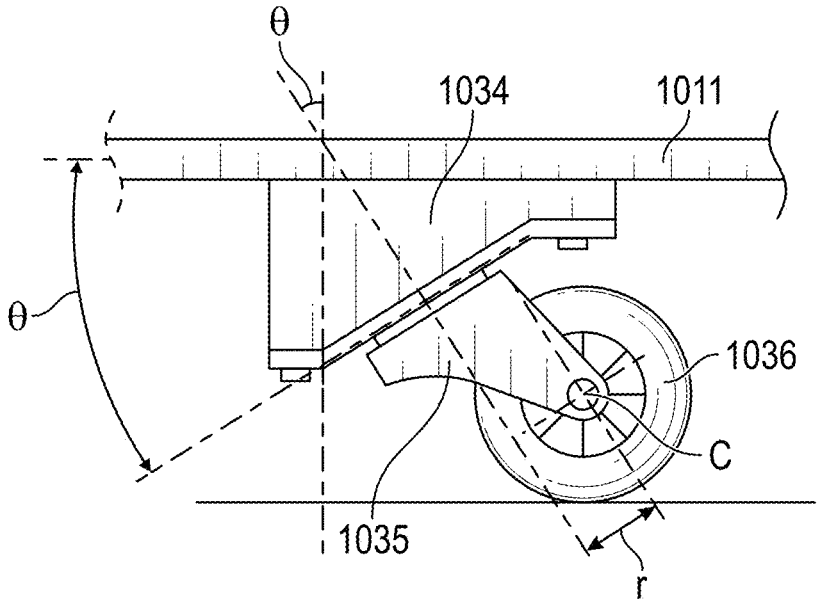
FIG. 10 shows a side view of an angled caster or direction-caster.

FIG. 10 shows a close-up view of an example direction-caster comprising a wheel support 1034 attached to a plate 1011 (which can comprise or be attached to a platform 12, 112, etc. such as that illustrated in the other figures), a roller arm 1035 which is pivotably connected to the wheel support 1034, and a roller 1036 which is rotatably connected to the free-end parts of the roller arm 1035 to form a fork for an axle. The wheel support 1034 has the shape of a wedge, so that an acute angle θ is formed between the contact surface of the wheel support 1034 and the plate 1011 and the facing surface of the wheel support 1034 and the extension direction of the roller arm 1035.

This angle can be used by a rider who tips or sways laterally on a skating board to generate forward motion, for example. With a skateboard having direction-casters (and as illustrated in FIG. 3a of U.S. Pat. No. 7,195,259, for example), if the rider leans the front board to its right side with respect to the advancing direction of the skateboard, the roller arm 1035 of the front direction-caster turns to the left side and the roller 1036 rolls to the right direction with respect to the advancing direction, so that the rider can turn to the right direction. Alternatively (as illustrated in FIG. 3b of U.S. Pat. No. 7,195,259, for example), if the rider leans the rear board on its right side with respect to the advancing direction, the roller arm of the rear direction-caster turns to the left side and the roller rolls to the right with respect to the advancing direction, so that the rear board turns to the right, with the result that the rider can turn to the left direction.

Combining these two effects (and as illustrated in FIGS. 3c of U.S. Pat. No. 7,195,259, for example), when the rider leans the front board to its right side and the rear board to its left side with respect to the advancing direction, the rider can turn to the right direction within a small turning radius. In addition, if the rider leans both boards to the same lateral side with respect to the advancing direction, he/she can advance in that direction with both boards advancing in parallel.

As illustrated in FIG. 3d of U.S. Pat. No. 7,195,259, for example, the mechanics for generating the driving force is shown, where the rider makes twisting motion to the left direction with respect to the advancing direction. As the rider twists to the left direction, the front board is biased to +y direction and the rear board is biased to −y direction, so that the direction-casters make rolling angles with respect to the advancing direction proportional to the magnitude of the biasing forces received by the boards. Because of the characteristics of the wedge shape of the wheel supports (e.g., 1034) for the direction-casters, forces are generated in the rolling direction of the direction-casters. So the horizontal component forces of the forces generate the driving forces which accelerate the skateboard. As a result, with the skateboard having direction-casters, there is no need for the rider to stamp on the ground for generating the driving force, instead, he/she needs only to twist his/her body right and left without moving his/her feet. The vertical force components make a moment to make the skateboard rotate around its center of gravity.

As further explained in U.S. Pat. No. 7,195,259, a spring can be used to provide a restoring force that counteracts a rider's twisting force described above. This can help a rider safely maintain his/her balance by its restoring force when the rider twists the front and rear boards right and left to make a turn or to generate driving force while riding the skateboard. Two or more direction-casters, which are mounted on the underside of the plates, can be installed so as to be aligned along a longitudinal axis of the plates, or so as to be parallel in a side-by-side arrangement. With the longitudinal or the parallel configuration, the skateboard has a relatively larger turning radius, but this configuration can improve safety and stability (e.g., similar to how a tricycle is configured).

Figure 11A:
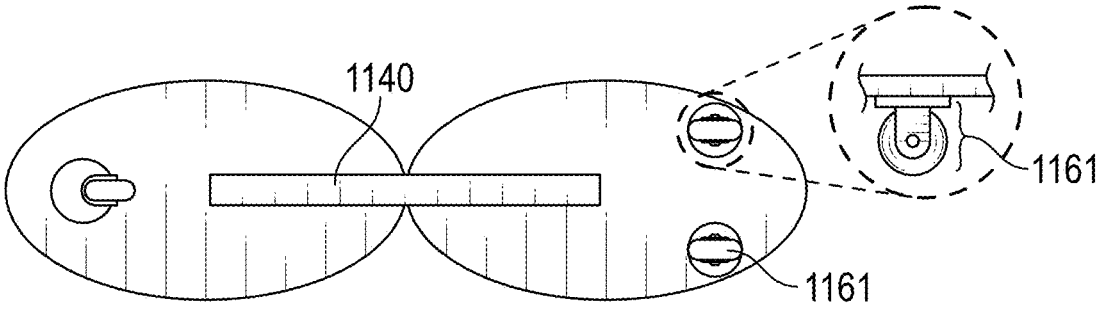
FIGS. 11A-11B show bottom views of casters arranged on two-part boards, resiliently joined.

As seen in FIG. 11A, a direction-caster can be installed in the front board, but one or more fixed roller sets 1161, in which the roller cannot be rotated on the axis of the roller arm, can be adopted in the rear board. With this configuration, turning of the skateboard can be effected best by the front board. So, in consideration of safety, this skateboard can be more suitable for younger children.

Figure 11B:
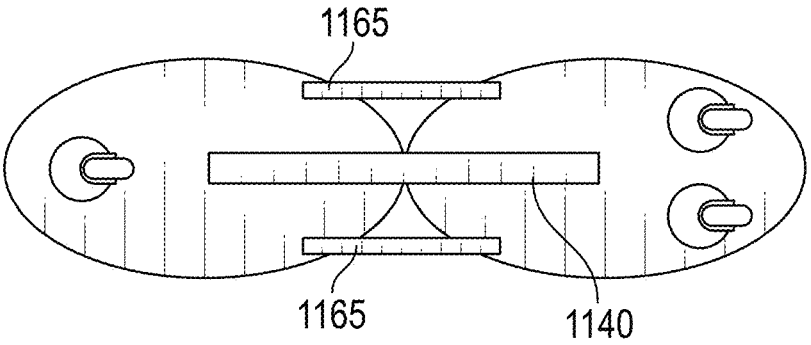

In FIG. 11B, a twist-pipe 1140 may be equipped with a spring, and/or two flexible rubber members 1165 can be positioned parallel to the twist-pipe 1140. The two flexible rubber members 1165 can be connected at each of their one ends to the front board and at their other ends to the rear board. A spring-like restoring force can be obtained by these flexible rubber members 1165 when the twist-pipe 1140 is twisted.

The direction-casters described above, and the related propulsion that can be generated from a sequence of lateral tipping to alternate sides, can generate significant stress on materials that connect a board or plate and the connected wheels or direction-casters. Accordingly, it can be important to establish a strong and secure connection between wheels or direction-casters and a related skating board or similar apparatus. The figures above illustrate robust connecting structures to address this need. For example, the wheel cartridge 140 of FIG. 7C can have a square or rectangular base 140*a* that fits into a track 120 such that the wheel cartridge 140 maintains a secure connection and does not itself twist or work loose from the track 120 (even while the connected caster wheel 140*b* can both twist side to side and rotate freely as designed). Similarly with respect to FIGS. 4 and 5, a wheel lock (e.g., the latch 126) and the snug or close fit between the base 14*a* and the track 20 can help secure the base 140*a* such that the caster wheel 140*b* can swivel freely from a secure and non-rotating base 140*a*. This secure connection can allow the propulsion methods described above, while retaining the integrity of a skating device such as a caster board, for example.

Propulsion, Direction Vectors and Torsion in Caster Boards

As explained in U.S. Pat. Nos. 7,195,259 and 7,388,056, skateboards can have a front platform and a rear platform spaced apart and interconnected (e.g., with a narrow neck or a torsion bar or other element which permits the front or rear platform to be twisted or rotated with respect to the other platform). However, as further explained in U.S. Pat. No. 7,388,056, a one-piece platform can be propelled using similar principles and motions. That patent discloses a flexible skateboard having a one piece platform formed of a material twistable along a twist axis, the material formed to include a pair of foot support areas along the twist axis, generally at each end of the platform, to support a user's feet. A central section is provided between the foot support areas. Such a skateboard can have a pair of caster assemblies, each having a single caster wheel mounted for rolling rotation, each caster assembly mounted at a user foot support area for steering rotation about one of a pair of generally parallel pivot axes each forming a first acute angle with the twist axis. The central section of the platform material may be configured to be sufficiently narrower than the foot support areas to permit the user to add energy to the rolling rotation of the caster wheels by twisting the platform alternately in a first direction and then in a second direction with the foot support areas.

With further reference to U.S. Pat. No. 7,388,056, the central section in the material may be sufficiently resistant to twisting about the twist axis in response to forces applied by the user to provide feedback to the user before steering the caster assemblies in opposite directions about their related pivot axes. The central section may include vertical support providing sufficient resistance to bending along the twist axis to support a user on the foot support areas for comfortably riding the platform without substantial bending along the twist axis, such as a sidewall running along each edge of the central section running along the twist axis which may have a height decreasing towards the ends of the central section. An insert may be mountable between the sidewalls to increase the resistance to twisting of the central section.

With further reference to U.S. Pat. No. 7,388,056, the foot support areas are sufficiently more resistant to twisting about the twist axis than the central section to reduce stress caused by twisting of the user's feet. A wedge mounted between each of the pair of caster assemblies and the platform to support the related caster assembly for steering rotation about the related pivot axis and/or a hollow wedge may be formed in the platform for mounting each related caster assembly for steering rotation about the related pivot axis. A threaded rod may be used to secure the caster assembly to the platform with a nut mounted within the related hollow wedge.

With further reference to U.S. Pat. No. 7,388,056, tension, compression or torsion springs may be mounted to each caster assembly for centering the wheel therein along the twist axis. The torsion springs may be mounted around the pivot axis and/or within the related wheel assembly. The platform may be configured to operate as a non-flexible skateboard within a first range of forces applied by the user to twist the board and/or configured to operate as a flexible skateboard for forces greater than the first range.

With further reference to U.S. Pat. No. 7,388,056, a one-piece flexible skateboard body can have a one-piece flexible platform having a narrow section twistable about a long axis, and mountings for each of a pair of steerable casters. The narrow section may be sufficiently twistable about the long axis by a rider to cause the board to move forward from a standing start on the steerable casters when mounted and/or sufficiently rigid to prevent bowing when supporting a rider on the steerable casters. The narrow section may be sufficiently rigid so that the platform may be operated as either a non-flexible or flexible skateboard when the steerable casters are mounted. The remainder of the platform may be more resistant to flexing than the narrow section and hollow wedges may be molded into the flexible platform. A mounting point may be provided for a spring configured to center the steerable casters along the long axis.

Figure 12A:
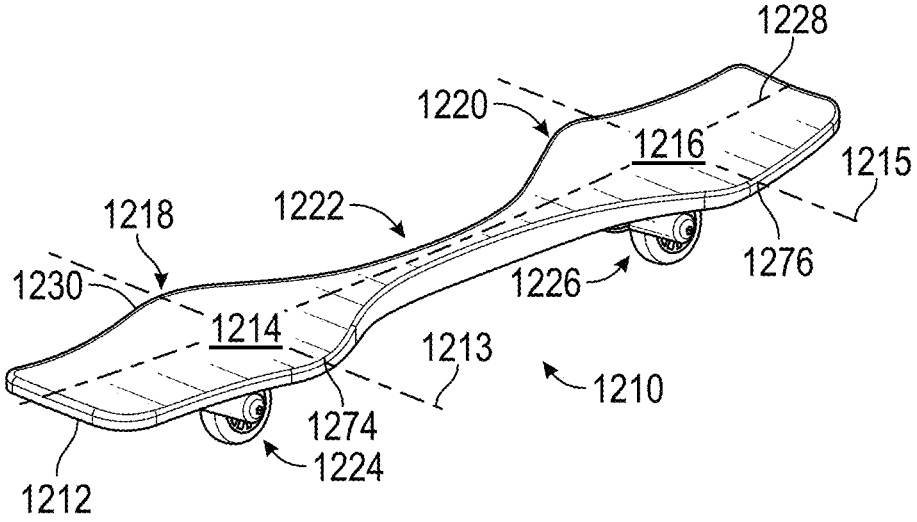
FIGS. 12A-12B illustrate an embodiment of a one-piece flexible skateboard.
Figure 12B:
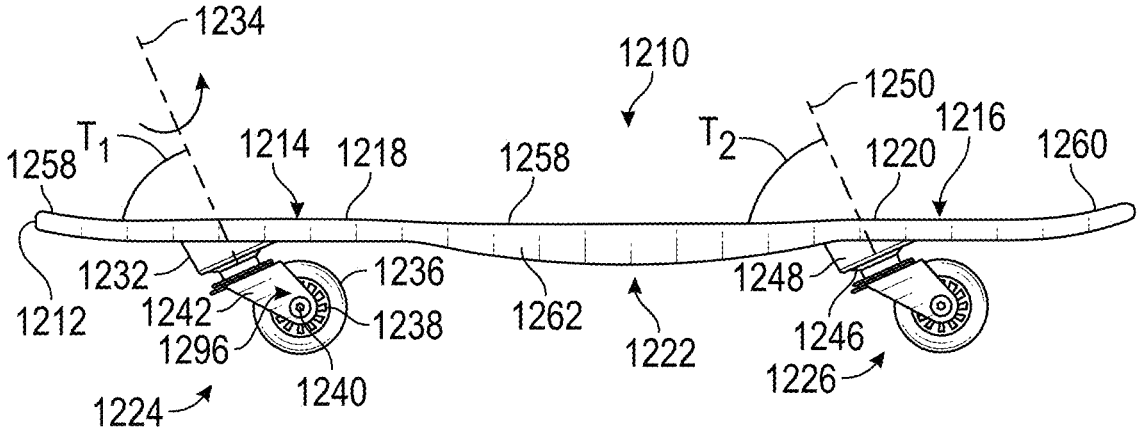

FIGS. 12A and 12B illustrate an embodiment of a one-piece flexible skateboard, consistent with the description of U.S. Pat. No. 7,388,056. Flexible skateboard 1210 is preferably fabricated from a one-piece, molded plastic platform 1212 which includes foot support areas 1214 and 1216 for supporting the user's feet about a pair of directional caster assemblies mounted for pivoting or steering rotation about generally parallel, trailing axes. Each caster assembly (e.g., 1224, 1226) includes a single caster wheel mounted for rolling rotation about an axles positioned generally below the foot support areas 1214 and 1216*f*. Skateboard 1210 generally includes relatively wider front and rear areas 1218 and 1220, each including one of the foot support areas 1214 and 1216, and a relatively narrower central area 1222. The ratio of the widths of wider areas 1218 and 1220 to narrow central area 1222 may preferably be on the order of about 6 to 1. Wheel assemblies 1224 and 1226 are mounted below one-piece platform 1212 generally below foot support areas 1214 and 1216. Their mounting positions can be adjusted or they can be replaced in accordance with the principles and structural teachings of this disclosure.

In operation, the skateboard rider or user places his feet generally on foot support areas 1214 and 1216 of one-piece platform 1212 and can ride or operate skateboard 1210 in a conventional manner, that is as a conventional non-flexible skateboard, by lifting one foot from board 10 and pushing off against the ground. The user may rotate his body, shift his weight and/or foot positions to control the motion of the skateboard. For example, board 1210 may be operated as a conventional, non-flexible skateboard and cause steering by tilting one side of the board toward the ground. In addition, in a preferred embodiment, board 1210 may also be operated as a flexible skateboard in that the user may cause, maintain or increase locomotion of skateboard 1210 by causing front and rear areas 1218 and 1220 to be twisted or rotated relative to each other generally about upper platform long or twist axis 1228.

The relative rotation of different portions of platform 1212 about axis 1228 can change the angle at which the weight of the rider is applied to each of the wheel assemblies 1224 and 1226, which can cause these wheel assemblies to tend to swivel or steer about their pivot axes. This tendency to swivel or steer may be used by the rider to add energy to the rolling motion of each caster wheel about its rolling axle and/or to steer.

As a simple example, if the user or rider maintained the position of his rearward foot (relative to the intended direction of motion of board 1210) on foot support area 1216, generally along axis 1215 and parallel to the ground, while maintaining his front foot in contact with support area 1214, generally along axis 1213 while lowering, for example, the ball of his front foot and/or lifting the heal of that foot, front section 1218 of board 1210 would tend to twist clockwise relative to rear section 1220 when viewed from the rear of board 1210. This twist would result in the tilting right front side 1230 of board 1210 in one direction, causing the weight of the rider to be applied to wheel assembly 1224 at an acute angle relative to the ground rather than to be applied orthogonal to the ground, and would therefore cause wheel assemblies 1224 and 1226 to begin to roll, maintain a previous rolling motion and/or increase the speed of motion of the board 1210 e.g. by adding energy to the rolling motion of the wheels.

In practice, the rider can cause the desired twist of platform 1212 of board 1210 in several ways which may be used in combination, for example, by twisting or rotating his body, applying pressure with the toe of one foot while applying pressure with the heel of the other foot, by changing foot positions and/or by otherwise shifting his weight. To provide substantial locomotion, the rider can first cause a twist along axis 1228 in a first direction and then reverse his operation and cause the platform to rotate back through a neutral position and then into a twist position in the opposite direction. Further, while moving forward, the rider can use the same types to motion, but at differing degrees, to control the twisting to steer the motion of board 1210. The rider can, of course, apply forces equally with both feet to operate board 1210 without substantial flexure.

Wider sections 1218 and 1220 have an inherently greater resistance to twisting about axis 1228 than narrower section 1222 because of the increased stiffness due to the greater surface area of the portions to be twisted. That is, narrower section 1222 is narrower than wider sections 1218 and 1220. The resistance of the various sections of platform 1212 to twisting can also be controlled in part by the choice of the materials, such as plastic, used to form platform 1212, the widths and thicknesses of the various sections, the curvature if any of platform 1212 along axis 1228 or along any other axes and/or the structure and/or cross section shape of the various sections.

Referring now to FIG. 12B, skateboard 1210 may include sidewalls 1262 and/or other structures. Sidewalls 1262 may be increased in height, e.g. orthogonal to the top surface 1258 of platform 1212, in the central portion of central area 1222 to provide better vertical support if required. In a preferred embodiment, the height of sidewall 1262 in central area 1222 varies from relatively tall in the center of board 10 to relatively shorter beginning where areas 1218 and 1220 meet central area 1222. The ratio of the sidewall height "H" in central section 1222, to the side wall heights in wider areas 1218 and 1220 may preferably be on the order of about 2 to 1.

As shown in FIG. 12B, wheel assemblies 1224 and 1226 may be substantially similar. (However, as taught elsewhere herein, the assemblies may differ and one or both may be independently connectable and/or translatable laterally and/or longitudinally). Wheel assembly 1224 may be mounted to an inclined or wedge shape wheel assembly section 1232 by the insertion of pivot axle 1241 (visible in FIG. 13) into a suitable opening in wedge 1232 for rotation about axis 1234. The rotation of wheel assembly 1224 about axis 1234 may preferably be limited, for example, within a range of about ±180°, and more preferably within a range of about ±160°, of tilt with respect to an upright position orthogonal to the plane of platform 1212 to improve the handling and control of board 1210. Each direction caster may include a tension, compression or torsional spring to provide self-centering, that is, to maintain the alignment of wheels 1236 along axis 1228 (visible in FIG. 12A) as shown and described for example with reference to FIG. 15.

With further reference to FIG. 12B, a pair of wedges 1232 and 1248 may each include a hole for wheel assembly axle mounted along a swivel axis 1234 or 1250. Wedges 1232 and 1248 may be formed as separate pieces from platform 1212 and be connected thereto by a user as described above for example by clips or a snap-in arrangement in which the upper surfaces of wedges 1232 and 1248 are captured by an appropriate receiving section molded into the lower face of platform 1212. Wedge 1232 may be used to incline the axes 1234 and 1250. The caster may swivel, pivot or turn about these axes. The axes 1234 and 1250 can form an angle $T_1$ or $T_2$ with respect to the upper surface 1258 of platform 1212. One useful angle for $T_1$ and/or $T_2$ can be about 24°.

With further reference to FIG. 12B, wheel assembly 1224 may include wheel 1236 mounted on hub 1238 which is mounted to axle 1240 for rotation, preferably with bearings. Axle 1240 is mounted in fork 1296 of caster frame 1242. A bearing or bearing surface may preferably be inserted between caster frame 1242 and wedge 1232, or formed on caster frame 1242 and/or wedge 1232 and is shown as bearing 1246 in wheel assembly 1226 mounted transverse to axis 1250 in wedge 1248 in rearmost wider section 1220. Wheel assemblies 1224 and 1226 are mounted along axes 1234 and 1250, each of which form an acute angle, $T_1$ and $T_2$ respectively, with the upper surface of platform 1212. In a preferred embodiment, $T_1$ and $T_2$ may be substantially equal. The center of foot support 1214 may conveniently be positioned directly above axis 1240 in wheel assembly 1224 and center of foot support 1216 may be positioned similarly above the axis of rotation of the wheel in wheel assembly 1226. In some embodiments, a user can reposition a wheel assembly (e.g., using a track and snap-in structure such as described herein) to facilitate a wider or different stance, while maintaining alignment between the user's feet and the wheel assembly.

Platform 1212 of board 1210 is in a generally horizontal rest or neutral position, e.g. in neutral plane 1217, when no twisting force is applied to platform 1212 of board 1210. This occurs, for example, when the rider is not standing on board 1210 or is standing in a neutral position. When board 1210 is in the neutral position, axes 1234 and 1250, angles $T_1$ and $T_2$ and board axis 1228 (shown in FIG. 12A) are all generally in the same plane orthogonal to neutral plane 1217 of the top of platform 1212, while axes 1213 and 1215 are in neutral plane 1217. Upper surface 1258 may not be flat and in a preferred embodiment, toe or leading end 1260 and heel or trailing end 1262 of surface 1258 may have a slight upward bend or kick as shown. When a twisting force is applied to board 1210, one or more of axes 1234 and 1250 move out of the vertical plane as described below in greater detail with respect to FIGS. 14A-14E.

Figure 13:
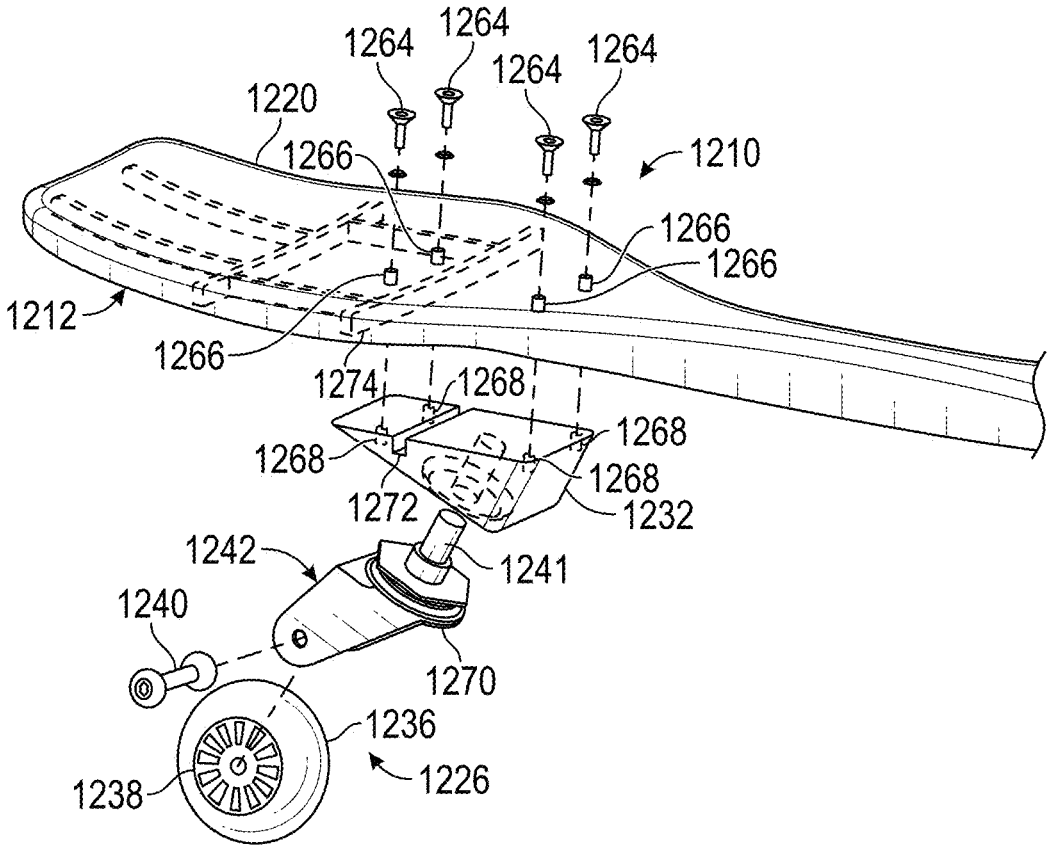
FIG. 13 shows an exploded isometric view of a portion of a board and wheel connection.

Referring now to FIG. 13, an exploded isometric view of a section 1220 of an embodiment of board 1210 is shown in which an inclined wedge 1232 is formed as a separate piece from platform 1212 and mounted thereto. Although illustrated here as a direct mount using four screws 1264 (inserted through holes 1266 in appropriate locations in platform 1212 to mate with holes 1268 in inclined wedge 1232), a similar wedge structure can be incorporated into the track attachment features described elsewhere in this disclosure. For example, the wedge 1232 can for part of a modular wheel unit and be removably and securely connectable to a platform 1212 in more than one position (e.g., along a longitudinal and/or lateral track such as the tracks 20 and 120 illustrated above). Alternatively, mounting screws such as the screws 1264 can be provided that can position a wedge 1232 and/or associated wheel assembly 1226 in multiple positions (for example, combining the teachings of FIGS. 8 and 13).

Frame 1242 of wheel assembly 1226 can include caster top 1270, a bearing cap and pivot axle 1241, a top portion of which is received by and mounted in a suitable opening in wedge 1232. Axle 1240 is mounted in fork 1296 of frame 1242. Wheel 1236 is mounted on hub 1238 which is mounted for rotation about axle 1240 within the fork-structure of the frame 1242 that spans to both sides of the wheel 1236.

Wedge 1232 may be further secured to platform 1212 by the action of slot 1272 which can capture a feature of the bottom surface of platform 1212 such as transverse rib 1274. As shown, wedge 1232 may be conveniently mounted to and dismounted from platform 1212 permitting replacement of wedge 1232 by other wedges with potentially different configurations including different angles of alignment for axis 1234 and/or other characteristics. In some embodiments, a track or other multi-position feature such as the track 120 of FIG. 7B or the track 20 of FIG. 6C can incorporate similar transverse ribs at periodic intervals to help secure a wheel base 14*a* and/or wedge 1232. Such a slot and rib conjunction can help prevent undesired twisting by a wheel base, which can lead to wobble, structural failure, interfere with smooth swivel steering motions by a user, etc. Thus, some embodiments include transverse ribs and a wheel lock (e.g., the latch 26 of FIGS. 4 and 5). This can improve structural rigidity and a snug or close fit between the base 14*a* and surrounding structures such as a track 20. This can in turn help secure the base 14*a* such that the rotating portion 14*b* can swivel freely from a secure and non-rotating base 14*a* (see FIGS. 4 and 5).

Figure 14A:
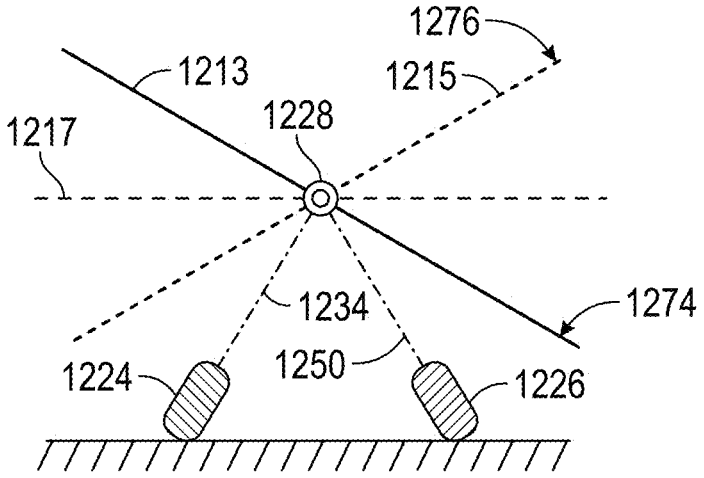
FIGS. 14A-14E illustrate motion and propulsion of the systems described herein.

Referring now to FIGS. 14A-14E, a graphical depiction of the motions of portions of platform 1212 are shown. Neutral plane 1217 is shown in the horizontal position indicating top surface 1258 of platform 1212 when no twisting forces are applied to skate board 1210. Axis 1228, along the centerline of top surface 1258 of platform 1212, is shown orthogonal to the drawing, coplanar with and centered in neutral plane 1217. Axis 1213 is shown as a solid line and represents the location of a cross section of the top surface of platform 1212 at front foot position 1214 in wide forward section 1218 when the port side of wide section 1218 is depressed below the horizontal or neutral plane 1217 for example by the user pressing down on the port side and/or lifting up of the starboard side of foot position 1214. Axis 1215 is shown as a dotted line, to distinguish it from axis 1213 for convenience, and represents the location of a cross section of the top surface of platform 1212 at rear foot position 1216 in wide aft section 1220 of platform 1212 when the starboard side of wide section 1220 is depressed below the horizontal or neutral plane 1217 for example by the user pressing down on the starboard side and/or lifting up of the port side of rear foot position 1216. Thus FIG. 14A represents the relative angles of wider front and rear sections 1218 and 1220 of platform 1212 when the user has completed a maneuver in which he has twisted wider front and rear sections 1218 and 1220 in opposite directions to a maximum rotation.

Wheel assembly 1224 is shown mounted for rotation about axis 1234. Axis 1234 of front wheel assembly 1224 remains orthogonal to axis 1213 of foot position 1214. Similarly, wheel assembly 1226 is shown mounted along axis 1250. Axis 1250 of rear wheel assembly 1226 remains orthogonal to axis 1215 of foot position 1216. For ease of illustration, wheel assemblies 1224 and 1226 are depicted in cross section without rotation of the wheel assemblies about axes 1234 and 1250.

In the position shown in FIG. 14A, wheel assemblies 1224 and 1226 have presumably been rotated from vertical positions to the opposite outward positions by action of the user in twisting board 1210. Front and rear wheel assemblies 1224 and 1226 are able to rotate or pivot about their respective axes 1234 and 1250. During the twisting of board 1210, wheel assemblies 1224 and 1226 rotate about the central axes of the wheels as long as such rotation takes less force than would be required to skid the wheel assemblies into the positions as shown. The direction of this rotation is not random, but rather controlled by the structure (e.g., a combination of the wedge 1232 of FIG. 12 and the wheelbase 14*a* of FIGS. 4 and 5) establishing angles $T_1$ and $T_2$ between axes 1234 and 1250 and platform 1212.

The view shown in FIG. 14A is looking at the front of board 1210 so that axes 1234 and 1250 are at right angles to one of the portions of platform 1212. A side view of the board 1210, as shown for example in FIG. 12B, illustrates that each wheel assembly is mounted for pivotal rotation about an axis at an acute trailing angle to platform 1212. The rotation of the wheels about each wheel axis of the wheel assemblies, combined with a slight rotation of each wheel assembly about its axis 1234 or 1250 when the ends of board 1210 are twisted in opposite directions, causes, maintains or increases forward motion or locomotion of board 1210 because axes 1234 and 1250 are inclined so that each wheel assembly is in a trailing configuration, aft of the point at which each axis penetrates board 1212 from below. That is, axes 1234 and 1250 about which each wheel assembly turns are both inclined in the same direction, preferably at a trailing angle (e.g., the same trailing angle) with respect to the direction of travel and are preferably parallel or nearly so.

Figure 14B:
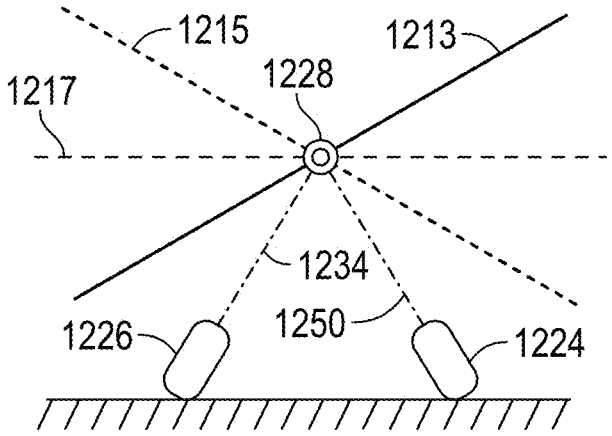

Referring now to FIG. 14B, axes 1213 and 1215 are shown in the opposite positions than shown in FIG. 14A, which would result from the user reversing his or her foot rotation, i.e., by twisting the front and rear sections of board 1210 by pushing down and/or lifting up opposite of the way done to cause the twisting shown in FIG. 14A. However, the combination of the rotation of the wheels and the rotation of the wheel assemblies adds to the forward locomotion because axes 1234 and 1250 are in a trailing position relative to the forward motion of board 1210.

Figure 14C:
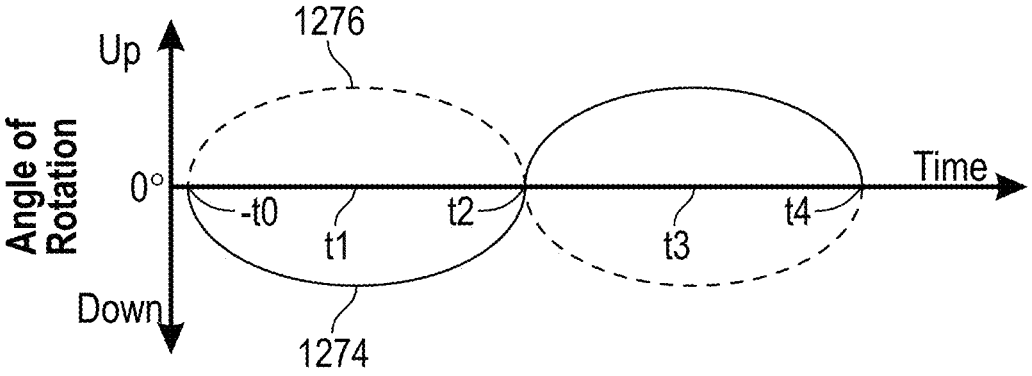

Referring now to FIG. 14C, the solid line is a graphical representation of the twisting rotation as a function of time of point 1274 (shown in FIGS. 12A, 13, and 14A) at a forward port side edge of wide section 1218 during the twisting motions occurring to board 1210 as depicted in FIGS. 14A and 14B. Point 1274 may be considered to be the point at which axis 1213 intersects the port side edge of platform 1212. At some instant of time, such as to, point 1274 is at zero rotation. As the port side of forward wide section 1218 is rotated downward by force applied by the user, point 1274 rotates downward until the maximum force is applied by the user and point 1274 reaches a maximum downward rotation at some particular time such as time $t_1$. Thereafter, as the downward force applied by the user to the portside of forward section 1218 decreases, the downward angle of rotation of point 1274 decreases until at some time $t_2$, point 1274 returns to a neutral rotational position at a rotational angle of zero.

Thereafter, downward pressure can be applied by the user to the starboard edge of section 1218, e.g. in foot position 1214, to cause point 1274 on the port side to twist or rotate upwards, reaching a maximum force and therefore maximum rotation at time $t_3$ after which the force may be continuously reduced until neutral or zero rotation is reached at time $t_4$. Similarly, as shown by the solid line in FIG. 14C, the user can apply forces in the opposite direction to rearward wide section 1220 so that point 1276, at the rearward port side of foot position 1216, rotates from the neutral position at time to, to a maximum upward rotation at time $t_1$, through neutral at time $t_2$, to a maximum downward rotation at time $t_3$ and back to neutral at time $t_4$.

Figure 14D:
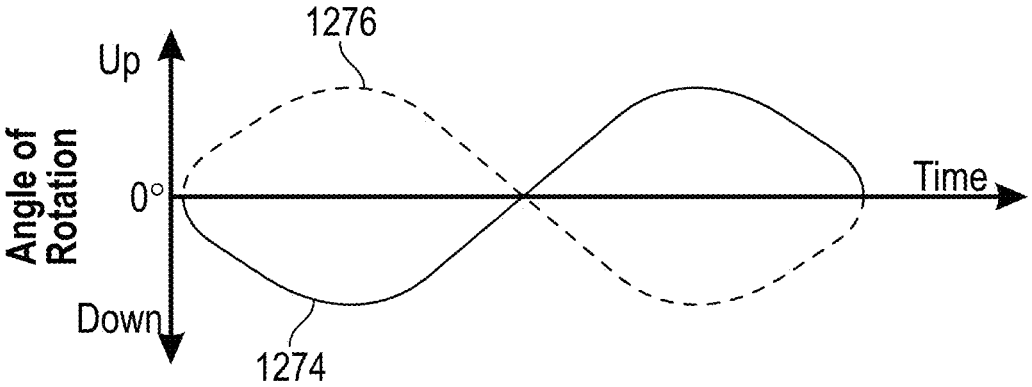

Referring now to FIG. 14D, the amount of force that must be applied by the user to cause a particular degree of twist may correlate to the amount of control the user has with board 1210. It may be desirable for the relationship between force and rotation to be varied as a function of rotation or force. For example, in order to achieve a "stiff" board while permitting a large range of total twist without requiring undo force, the shape of platform 1212 may be configured so that the amount of force required to twist the board from the neutral plane seems relatively high to the user (at least high enough to be felt as feedback) even if the additional force required to continue rotating each section of the board past a certain degree of rotation seems relatively easier to the user. Further, as an added safety and control measure, the additional force required to achieve maximum rotation may then appear to the user to increase greatly. As shown in FIG. 14D, the shape of the graphs of the rotation of points 1274 and 1276, for the same forces applied as a function of time used to create the graph in FIG. 14C, may be different, providing a different feel to the user.

Figure 14E:
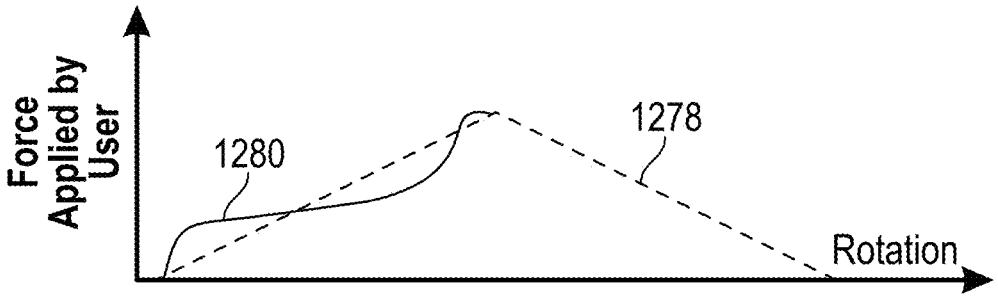

Referring now to FIG. 14E, the concept just discussed above may be viewed in terms of a graph of force applied by the user as a function of desired rotation. The control feel desired for a skate board is not necessarily an easily described mathematical function of force to rotation. For some configurations of platform 1212, with specific shapes and relationships between the front and rear wide areas and the central narrow area, and specific shapes and sizes of sidewalls, ribs, surface curves and other factors, there will be a particular way in which the board feels to the user to behave. That is, the feel of the board and especially the user's apparent control of the board, in preferred embodiments, is dependent on the shape and other board configuration parameters. For simplicity of this description, one particular board configuration may be said to have a "linear" feel, that is, the user's interaction with the board may seem to the user to result in a linear relationship between force applied and rotation or twist achieved. In practice, this feel is very subjective but none the less real although the actual mathematical relationship may not be linear. As a relative example, line 1278 may represent a linear or other type of board having a first configuration of platform 1212.

The response, performance, and configuration of platform 1212 may be adjusted, for example, by increasing or reducing a distance between wheels along axis 28 (see FIG. 12A). For a particular configuration of platform 1212, shortening this distance may result in a perceived sloppiness of control by the user while lengthening may result in a greater control but larger and more unwieldy turning radius.

Tightness of control can also be enhanced or maintained by securing a modular, re-positionable wheel assembly such as those disclosed above in a tight and non-twistable manner on or against the bottom of a platform 1212. Providing sidewalls of a track 20 or 120, and snugly or tightly positioning an angular wedge or block-shaped wheel base (see, e.g., 14*a* of FIG. 5 or 140 of FIG. 6C or 1034 of FIG. 10) within those sidewalls can help suppress or avoid undesirable sloppiness of control. If some resiliency is desired, it can be provided by resiliency of the wheel and/or a resilient bearing related to the joint between a wheel and wheel base.

One advantage of the use of one-piece platform 1212 made of a plastic, twistable material formed in a molding process, is that the desired feel or control of the board can be achieved by reconfiguration of the mold for the one-piece platform. Similarly, an advantage of using an adjustable wheel assembly is that it allows a user to quickly and conveniently adjust the desired feel or control of the board. Although it may be difficult to predict (e.g., with mathematical precision), the wheel separation or other position needed to achieve a desired feel, it is possible to iteratively change that separation or position by moving one or more of the wheel assemblies to achieve a desirable configuration with an appropriate feel. In particular, the relationship between force applied and twist or rotation achieved by flexible skateboard 1210 is a function not only of the relative widths, shapes and other configuration details of platform 1212, but also of the relative positions of the wheels. Platform 1212 (and other components described herein) may be molded or otherwise fabricated from flexible PU-type elastomer materials, nylon or other rigid plastics and can be reinforced with fiber to further control flexibility and feel and provide strength and appropriate rigidity for mounting and securing caster wheel assemblies, for example.

Figure 15:
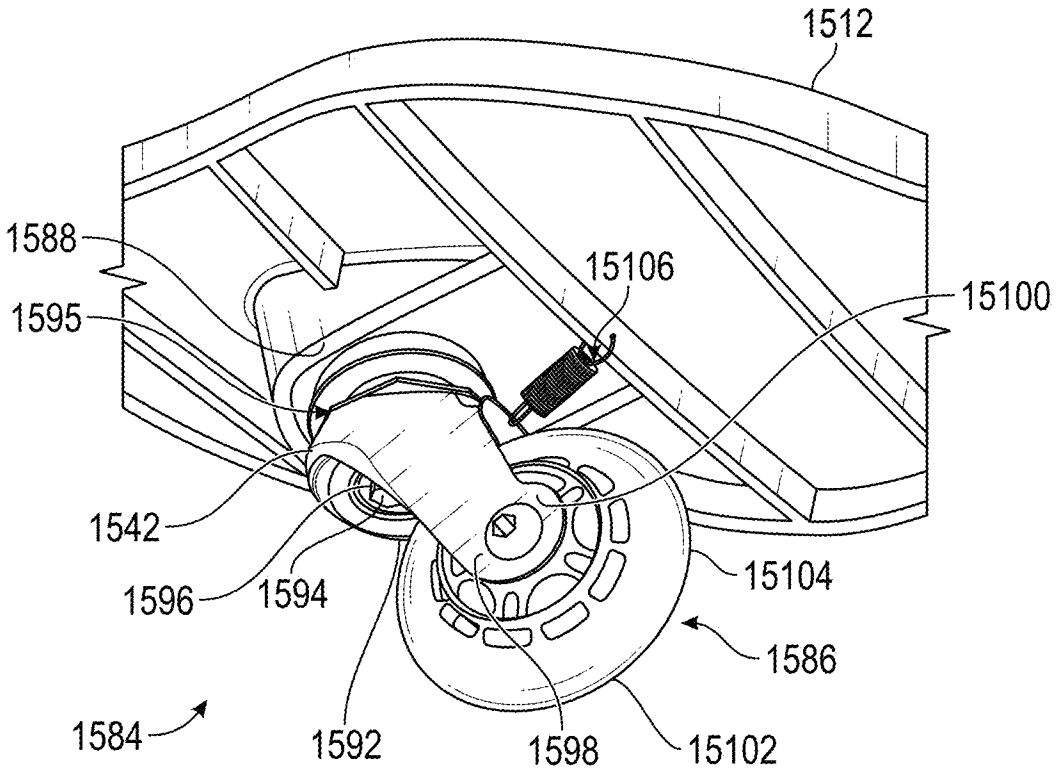
FIG. 15 shows a partial perspective view of a self-centering caster and related parts.

Referring now to FIG. 15, a partial view is shown of a self-centering section (e.g., front section) of a one-piece flexible board 1210 (see FIGS. 12A-13) or platform 1212. A caster wheel assembly 1586 is mounted to hollow wedge 1588 formed underneath front foot support of board 1210. Through bolt 1592, only the head of which is visible in this figure, may be positioned through the inner race of wheel assembly steering bearing 1594, bearing cap 1595 and the lower surface of wedge 1588 and captured with a nut, not visible here, accessible from the top of platform 1212 of board 1210 in the hollow volume of wedge 1588. The outer race of bearing 1594 is affixed to fork 1596 of caster wheel assembly 1586, which is mounted by bearing 1594 for rotation with respect to bearing cap 1595, so that wheel assembly 1586 can swivel or turn about the central axis (shown as turning axis 1234 or 1250 in FIG. 12B) of through-bolt 1592 which serves as a pivot axis with respect to the fixed portions of board 1210. Axle bolt 1598 is mounted through trailing end 15100 of fork 1596 to support bearing and wheel assembly 15102 for rotation of wheel 15104.

In a preferred embodiment, a spring action device may be mounted between caster wheel assembly and some fixed portion 1512 of a platform (or of a portion of a caster assembly fixed thereto) to control the turning of fork 1596 and therefore caster wheel assembly 1586 about turning axis 1234 or 1250 to add resistance to pivoting or turning as a function of the angle of turn. In some embodiments, for example a caster wheel assembly can be self-centering. The self-centering aspects of caster wheel assembly 1586 tends to align wheel 15104 with long axis 1228 (visible in FIG. 12A) when the weight is removed from board 1210, for example, during a stunt such as a wheelie. Without the self-centering function of the spring action device, caster wheel assembly 1586 may tend to spin about axis 1234 through bolt 1592 during a wheelie so that caster wheel assembly may not be aligned with the direction of travel of board 1210 at the end of the wheelie when wheel 15104 makes contact with the ground. The self-centering function of caster wheel assembly 1586 improves the feel and handling of board 1210, especially during maneuvers and stunts, by tending to align wheel 15104 with the direction of travel when wheel 15104 is not in contact with the ground. The spring action device may be configured to add or not add appreciable resistance to maneuvers such as locomotion or turning when wheel 15104 is in contact with the ground, depending on the desired relationship between forces applied and the resultant twist of platform 1212.

As shown in FIG. 15, caster wheel assembly 1586 may be made self-centering by adding coil spring 15106 between fork 1596 (or any other portion of caster wheel assembly 1586 which rotates about the axis of bolt 1592) and front section 1584 of platform 1122 (or any other fixed portion of platform 1212). Alternatively, a torsion spring can be incorporated into the bearing or elsewhere in the bearing and wheel assembly 15102 to cause a self-centering effect, thereby helping reduce foot fatigue in a user, for example. The internal torsion spring can be useful to avoid a need for connecting a coil spring such as the spring 15106 when repositioning a wheel assembly as described herein.

Figure 16:
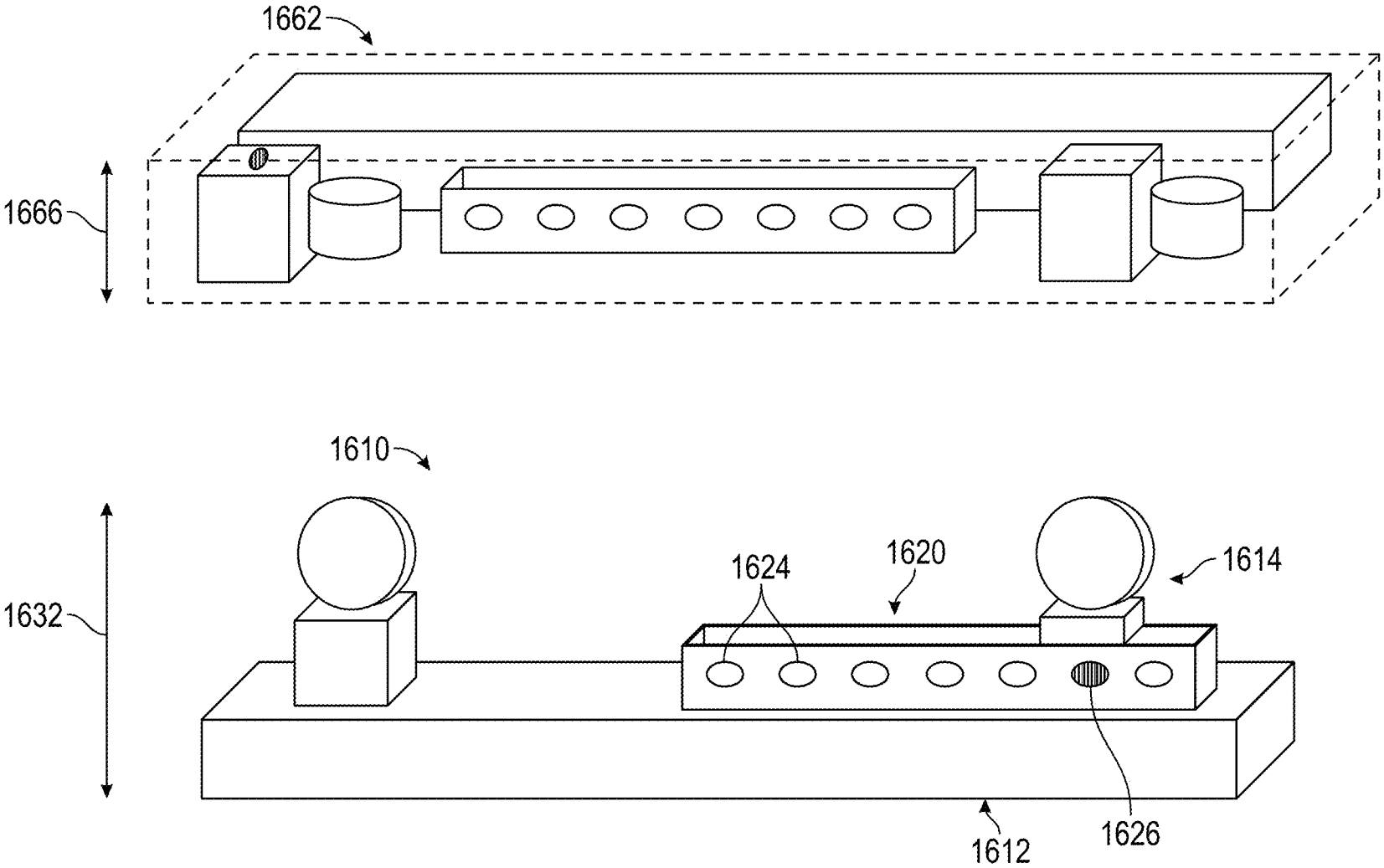
FIG. 16 shows how modules and related parts as disclosed herein can be arranged efficiently, for example in a shipping package that is thinner than an assembled version.

As shown in FIG. 16, a compact kit for assembling a skateboard can comprise a skateboard deck 1612, a securement module 1620 having multiple wheel bays, and at least one wheel assembly 1614 having a base configured for insertion into the multiple wheel bays. The kit can comprise a package 1662 that efficiently positions the skateboard deck 1612, the securement module 1620, and the at least one wheel assembly 1614 generally within the same plane to form a flat pack, which can have a shorter height 1666 than a height 1632 of an assembled skateboard 1610. AAs schematically illustrated, a kit or system can further comprise a second wheel assembly, which can also attach to the deck 1612 (e.g, using a second securement module or other means). The package 1662 can be configured to position the second wheel assembly (and/or a second securement module) generally within the same plane to form the flat pack as part of the package 1662, for example. A modular, assemblable skateboard can thus provide efficiencies for packing into containers having size and shape constraints.

There are several alternatives to the configuration and approach shown in FIG. 16. For example, a fixed wheel can be secured to the deck 1612 prior to shipping. A securement module 1620 can be secured to the deck prior to shipping, or formed integrally therewith (as shown for example in FIGS. 4 and 5). Various different packing arrangements are possible to efficiently position modules or other parts into a tight "flat pack" packaging.

Conclusion

Illustrative embodiments of various conveyances and vehicles (e.g., casterboards, skateboards, etc.) with repositionable wheels have been disclosed. Although this disclosure has been described in terms of certain illustrative embodiments and uses, other embodiments and other uses, including embodiments and uses which do not provide all the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of embodiments of casterboards with adjustable wheel positions have been disclosed. For purposes of summarizing the disclosure, certain aspects, advantages and features of the inventions have been described herein. It is to be understood that not necessarily any or all such advantages are achieved in accordance with any particular embodiment of the inventions disclosed herein. This disclosure extends beyond the specifically disclosed embodiments and examples to other alternative embodiments and/or other uses of the embodiments, as well as to certain modifications and equivalents thereof.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Likewise, the word "connected", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

Moreover, conditional language used herein, such as, among others, "can," "could," "might," "can," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The above detailed description is not intended to be exhaustive or to limit the invention to the precise form disclosed above. While specific embodiments of, and examples are described above for illustrative purposes, various equivalent modifications are possible within the scope of the disclosed invention(s), as those skilled in the relevant art will recognize.

The teachings provided herein can be applied to other apparatuses, embodiments, and systems, not necessarily those described above. The elements and acts of the various embodiments described above can be extracted, subdivided, and/or combined to provide further embodiments.

While certain embodiments have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics can be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

In the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

The following is claimed:

1. A casterboard comprising:

a deck configured to support a user;

a front caster wheel;

a rear caster wheel;

an access region; and a wheel lock;

wherein at least one of the front caster wheel and the rear caster wheel comprises a movable wheel that is configured to translate from a first position to a second position relative to the deck;

wherein the wheel lock comprises a latch on the movable wheel and a plurality of openings in the deck; and wherein the wheel lock is configured to secure the movable wheel in the first and the second positions.

2. The casterboard of claim 1, wherein the movable wheel is configured to translate along a track in the deck.

3. The casterboard of claim 1, further comprising an access region configured to enable the movable wheel to be removed from the deck.

4. The casterboard of claim 1, wherein the movable wheel that is configured to translate in a direction that is generally parallel to a longitudinal axis of the casterboard.

5. The casterboard of claim 1, wherein the wheel lock comprises a set screw.

6. The casterboard of claim 1, wherein the movable wheel is motorized.

7. The casterboard of claim 1, wherein the front caster wheel is the movable wheel.

8. The casterboard of claim 1, wherein the rear caster wheel is the movable wheel.

9. The casterboard of claim 1, further comprising a neck portion that is narrower than a front and rear portion of the deck.

10. An adjustable wheel mobility vehicle comprising:

a support structure configured to support a rider, the support structure comprising a casterboard deck having two widened portions configured to support two feet of the rider, the two widened portions separated by a resilient portion;

at least one modular conveying feature comprising a wheel for conveying the rider and the support structure, the wheel positioned beneath one of the widened portions;

a second wheel positioned beneath another one of the widened portions;

at least one attachment in the support structure, the attachment located beneath one of the widened portions, the attachment configured to physically secure the at least one modular conveying feature to the support structure in at least two different positions; and a tool-free mechanism configured to allow a user to free the at least one modular conveying feature from attachment to the support structure for movement between the at least two different positions.

11. The vehicle of claim 10, further comprising a second wheel, wherein movement of the at least one modular conveying feature between the at least two different positions changes a distance between it and the second wheel.

12. The vehicle of claim 11, wherein the second wheel is fixed with respect to the support structure.

13. The vehicle of claim 10, wherein the attachment comprises multiple holes through a portion of the support structure.

14. The vehicle of claim 10, wherein the attachment comprises a longitudinal track and the modular conveying feature comprises a wheel base configured to closely fit within the track.

15. The vehicle of claim 14, wherein the attachment further comprises a protrusion extending into an opening to secure the modular conveying feature at a particular position within the longitudinal track.

16. The vehicle of claim 14, wherein the attachment further comprises edge walls of the wheel base and parallel walls of the longitudinal track that cooperate to prevent rotation of the wheel base.

17. The vehicle of claim 16, wherein the wheel base supports a caster wheel for pivoting about a pivot axis for rolling about a rolling axis.

18. The vehicle of claim 17, wherein, in both of the at least two different positions, the wheel base positions the wheel at a non-perpendicular angle with respect to a principal plane of the support structure and provides a self-centering bias for the wheel.

19. The vehicle of claim 10, further comprising a wheel position indicator visible from above the support structure and configured to indicate to a rider a present position of the modular conveying feature.

20. The vehicle of claim 19, wherein the wheel position indicator comprises a viewing opening in the support structure and a portion of the modular conveying feature.

21. The vehicle of claim 10, wherein the tool-free mechanism comprises a wheel lock having resilient protrusions that can be displaced by human user's hand without a tool when repositioning the modular conveying structure between the at least two different positions.

22. A system for adjusting a skateboard wheel position, the system comprising:

a wheel support structure having multiple wheel attachment positions;

a wheel assembly comprising a skateboard wheel and a base, the wheel configured to swivel with respect to the base and the base configured to join to the wheel support structure;

the base and wheel support structure comprising complimentary structures that tightly join to prevent rotation of the base with respect to the wheel support structure and that retain the base in a first attachment position;

the wheel support structure comprising an elongate opening with at least two vertical walls having at least two side openings, the elongate opening sized to allow the base to slide into the opening while the at least two vertical walls maintain contact with corresponding walls in the base; and the base having at least one resilient protrusion that cooperates with the two side openings to form a release feature, the release feature configured to allow a user to easily loosen the base from the first attachment position of the wheel support structure and reposition the base in a second attachment position of the wheel support structure, such that the base is tightly retained in the second attachment position.

23. The system of claim 22, further comprising a skateboard deck configured to position the wheel support structure on its underside such that at least two wheels are provided to support the deck when in use.

24. The system of claim 22, wherein the release feature comprises at least one resilient tab lock that can be displaced and unlocked by a user's fingers.

25. A compact kit for assembling a disassembled skateboard kit, the kit comprising:

a skateboard deck;

a securement module having multiple wheel bays;

at least one wheel assembly having a base configured for insertion into the multiple wheel bays;

a package that positions the skateboard deck, the securement module, and the at least one wheel assembly to form a flat pack, wherein a plane parallel to the skateboard deck intersects the skateboard deck and the at least one wheel assembly.

26. The kit of claim 25, further comprising a second securement module having a bay and a second wheel assembly having a base configured for insertion into the bay of the second securement module, the package further configured to position the second securement module and the second wheel assembly generally within the same plane to form the flat pack.

27. The kit of claim 25, wherein the kit has a height, measured perpendicular to the plane, that is shorter than a height of the skateboard when assembled.

28. The kit of claim 25, wherein the securement module and the at least one wheel assembly are positioned in the package adjacent a lateral sidewall of the skateboard deck.

29. A casterboard comprising:

a deck configured to support a user;

a front caster wheel;

a rear caster wheel;

an access region; and a wheel lock;

wherein at least one of the front caster wheel and the rear caster wheel comprises a movable wheel that is configured to translate from a first position to a second position relative to the deck;

wherein the access region is configured to enable the movable wheel to be removed from the deck; and wherein the wheel lock is configured to secure the movable wheel in the first and the second positions.

30. A casterboard comprising:

a deck configured to support a user;

a front caster wheel;

a rear caster wheel; and a wheel lock;

wherein at least one of the front caster wheel and the rear caster wheel comprises a motorized movable wheel that is configured to translate from a first position to a second position relative to the deck; and wherein the wheel lock is configured to secure the motorized movable wheel in the first and the second positions.

31. An adjustable wheel mobility vehicle comprising:

a support structure configured to support a rider;

at least one modular conveying feature comprising a wheel for conveying the rider and the support structure;

a wheel position indicator visible from above the support structure and configured to indicate to a rider a present position of the modular conveying feature;

at least one attachment in the support structure, the attachment configured to physically secure the at least one modular conveying feature to the support structure in at least two different positions; and a tool-free mechanism configured to allow a user to free the at least one modular conveying feature from attachment to the support structure for movement between the at least two different positions.

32. An adjustable wheel mobility vehicle comprising:

a support structure configured to support a rider;

at least one modular conveying feature comprising a wheel for conveying the rider and the support structure;

at least one attachment in the support structure, the attachment configured to physically secure the at least one modular conveying feature to the support structure in at least two different positions; and a tool-free mechanism configured to allow a user to free the at least one modular conveying feature from attachment to the support structure for movement between the at least two different positions, the tool-free mechanism comprising a wheel lock having resilient protrusions that can be displaced by human user's hand without a tool when repositioning the modular conveying structure between the at least two different positions.

* * * * *